United States Patent [19]

Kobayashi et al.

[11] Patent Number: 4,520,095

[45] Date of Patent: May 28, 1985

[54] PHOTOGRAPHIC LIGHT-SENSITIVE ELEMENT

[75] Inventors: Tatsuhiko Kobayashi; Satoru Ikeuchi; Kazumasa Watanabe; Shunji Suginaka, all of Hino, Japan

[73] Assignee: Konishiroku Photo Industry Co., Ltd., Japan

[21] Appl. No.: 538,798

[22] Filed: Oct. 4, 1983

[30] Foreign Application Priority Data

Oct. 12, 1982 [JP] Japan ..... 57-179237

[51] Int. Cl.[3] ..... G03C 1/40; G03C 5/54

[52] U.S. Cl. ..... 430/223; 430/222; 430/241; 430/242; 430/562

[58] Field of Search ..... 430/223, 562, 225, 226, 430/242, 222, 241

[56] References Cited

U.S. PATENT DOCUMENTS 3,942,987 3/1976 Landholm et al. ..... 430/223

4,247,629 1/1981 Kanbe et al. ..... 430/223

*Primary Examiner*—Richard L. Schilling

*Attorney, Agent, or Firm*—Jordan B. Bierman

[57] ABSTRACT

A photographic light-sensitive element having at least one light-sensitive silver halide layer and a dye image forming non-diffusible material which, upon a redox reaction under alkaline conditions releases a diffusible cyan dye or precursor thereof wherein said material is (I)

wherein Car represents a carrier component having at least on Ball group as a part thereof which alone or together with other such groups in said Car renders said compound non-diffusible during development in alkaline processing solution, said Car being capable of releasing from said compound a diffusible dye or the precursor thereof as the result of a redox reaction under alkaline conditions:

R represents a hydrogen atom or an alkyl group having from 1 to 3 carbon atoms;

$R^1$ is wherein $R^2$ and $R^3$ are independently selected from a hydrogen atom, or an alkyl, a cycloalkyl or an aryl group having from 1 to 30 carbon atoms, and $R^2$ and $R^3$ may be linked through an oxygen atom or nitrogen atom to each other to form a 5-membered or 6-membered ring;

X is hydroxyl group or a salt thereof or a group which can be hydrolyzed to a hydroxyl group;

Y is wherein $R^4$ is an acyl, a hydroxyalkyl, an alkoxyalkyl, an alkoxyalkyleneoxyalkyl, a carboxyalkyl, carboxyphenyl, a carboxyalkyl-phenyl, a hydroxyalkyl-phenyl, or an alkoxyphenyl group;

$R^5$ is a hydrogen atom or an alkyl or an aryl having from 1 to 8 carbon atoms, or the same group as defined in $R^4$, provided the sum of the number of carbon atoms contained in $R^4$ and $R^5$ is not more than 10;

m is an integer of 0 or 1; and $J^1$ and $J^2$ are independently selected from divalent groups $—R^6—(0)_n—R_p^7—$ wherein $R^6$ and $R^7$ are independently selected from alkylene having from 1 to 8 carbon atoms, phenylene and phenylene substituted by a chlorine atom, methoxy group, or a methyl group;

n is an integer of 0 or 1; p is 1 when n is 1, and p is 1 or 2 when n is 0, provided that when p is 1, the sum of the number of the carbon atoms contained in $R^6$ and $R^7$ is not more than 13.

41 Claims, No Drawings

PHOTOGRAPHIC LIGHT-SENSITIVE ELEMENT

This Application claims the priority of Japanese Application No. 179237/1982, filed Oct. 12, 1982.

FIELD OF THE INVENTION

The present invention relates to a color diffusion transfer photographic light-sensitive element, and more particularly to a color diffusion transfer photographic light-sensitive element containing a non-diffusible cyan dye image forming material capable of releasing a diffusible cyan dye or the precursor thereof under an alkaline condition.

DESCRIPTION OF THE PRIOR ART

In the color diffusion transfer process which uses a dye image forming material (hereinafter referred to as C.P.M.), a light-sensitive silver halide emulsion layer and a light-sensitive layer combined therewith containing C.P.M. are exposed imagewise to light, whereby a latent image is formed in the light-sensitive silver halide emulsion layer. This image is then processed with an alkaline processing composition in the presence of a silver halide developing agent, at which time the above light-sensitive layer and an image receiving layer are superposed. As a result of processing the oxide of the silver halide developing agent is produced, and then the foregoing C.P.M. is oxidized or reduced to thereby release a diffusible dye or a precursor thereof. The diffusible dye or the precursor thereof released from the C.P.M. is transferred by diffusion to the above image receiving layer to form a dye image.

The above C.P.M. and color diffusion transfer processes using the C.P.M. are described in, e.g., U.S. Pat. Nos. 3,443,939, 3,443,940, 3,628,952, 3,968,897, 3,728,113, 3,980,479, 4,053,312, 4,076,529, 4,139,379, 4,139,389 and 4,199,354, Japanese Patent Publication Open to Public Inspection (hereinafter referred to as Japanese Patent O.P.I. Publication) Nos. 33826/1973, 54021/1979, 126331/1974, 99431/1974, 33141/1980, 104343/1976, 85055/1982, 16131/1981, 71061/1981, 105738/1982, 142530/1981, 164342/1981, 130927/1979, and the like.

Examples of the cyan dye-releasable C.P.M. are described in Japanese Patent O.P.I. Publication Nos. 126331/1979, 109928/1976, 33141/1975, and the like. However, the use of the cyan dye-releasable C.P.M.s described in these publications have drawbacks; they have insufficient oxidation or reduction reactions, the dye released during processing diffuses too slowly so that too much time is required to obtain a final transfer image, and transferred image density is not sufficiently high.

For example, U.S. Pat. No. 3,362,821 discloses a light-sensitive element which comprises a light-sensitive silver halide emulsion layer in combination with C.P.M., and a process control layer comprising a neutralizing layer and timing layer. The process control layer is arranged between the light-sensitive silver halide emulsion layer and the support; the neutralizing layer is present to terminate the development of the silver halide emulsion layer after a necessary developing period. The timing layer controls the lowering of the pH.

According to a preferred embodiment of the above-described light-sensitive element, the element comprises a support having thereon in order: a polymeric acid layer, a timing layer or insoluble spacer layer, a cyan C.P.M.-containing layer, a red-sensitive silver halide emulsion layer, an interlayer, a magenta C.P.M.-containing layer, a green-sensitive silver halide emulsion layer, an interlayer, a yellow C.P.M.-containing layer, a blue-sensitive silver halide emulsion layer, and an overcoat layer.

Such a light-sensitive element, after being exposed to light, is combined with an image receiving element, and processed in the presence of an alkaline processing composition to thereby obtain a transfer image. In such a process, an alkaline processing liquid permeates through the topmost layer downward in succession into the lower layers, thus commencing in order the developing of the respective layers. In this instance, the commencement of the development in the lowermost red-sensitive silver halide emulsion layer usually tends to be slightly later than that of the development in the upper blue-sensitive and green-sensitive silver halide emulsion layers. The release of the resulting cyan dye or the precursor thereof from the cyan C.P.M.-containing layer (in combination with the red-sensitive silver halide emulsion layer) is delayed, thus causing the color tone in the initial stage of the image transferred to the image receiving element to be lacking in cyan color.

In the foregoing light-sensitive element, after a specified period of time—although differing according to the type—after, e.g., 20–60 seconds, or not less than three minutes, the action of the process control layer arranged inside the light-sensitive layer reduces the pH to thereby stop the development. In this instance, necessary diffusion of the dye takes place, and after that, the element becomes stabilized.

In an ordinary process control layer, a timing layer is used together with the neutralizing layer comprised of a polymeric acid polymer, the timing layer preventing premature lowering of pH to stop the development. Therefore, the developing time depends upon the time required for the alkaline composition to permeate into the timing layer. As the pH of the system is lowered, the development of the silver halide, the release of the dye from the C.P.M.-containing layer, and the diffusion of the dye in the course of being diffused are substantially stopped. In a color diffusion transfer photographic element having the foregoing process control layer, the lowering of the pH of the system occurs from the portions proximate to the process control layer. As a result, development is stopped, in order, from the red-sensitive silver halide emulsion layer. Accordingly, the foregoing light-sensitive element is disadvantageous because the development of the red-sensitive silver halide emulsion layer begins later than, but is stopped earlier than that of the other silver halide emulsion layers.

As a means to solve these problems, it has been desired to use, in combination with the red-sensitive silver halide emulsion layer, a cyan C.P.M. whose oxidation or reduction reaction under alkaline conditions and the subsequent releasing reaction of the cyan dye or the precursor thereof are excellent over a wide pH range. The dye or the precursor thereof released from the C.P.M. should also have excellent diffusion characteristics in a binder such as gelatin.

OBJECTS OF THE INVENTION

It is an object of the present invention to provide a cyan C.P.M. capable of giving an excellent hue and having a stable cyan dye transfer color image.

It is another object of the present invention to provide a cyan C.P.M. comprising a cyan dye portion which has a high oxidation or reduction reactivity over a wide pH range and which has an excellent transferability.

It is a further object of the present invention to provide a color diffusion transfer photographic light-sensitive element containing a cyan C.P.M. capable of giving a relatively high-density cyan transfer dye image even in the presence of a relatively small quantity of a silver halide.

It is still another object of the present invention to provide a color diffusion transfer photographic light-sensitive element containing a cyan C.P.M. capable of giving a high-density cyan transfer dye image even when positioned over a process control layer.

CONSTRUCTION OF THE INVENTION

As a result of our various investigations it has now been found that the above objects can be accomplished by a photographic light-sensitive element comprising a support having thereon at least one light-sensitive silver halide emulsion layer and a cyan C.P.M. capable of releasing a diffusible cyan dye or the precursor thereof corresponding to the imagewise exposure of the emulsion layer. The above cyan C.P.M. is a compound having the formula:

Formula (I)

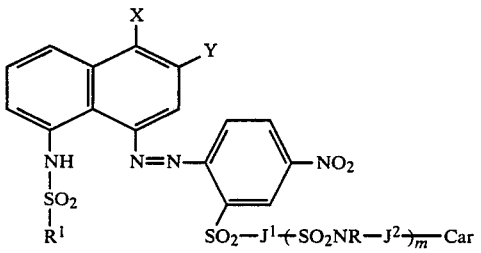

wherein Car represents a carrier component, having at least one ball ballasting group as a part thereof, the ball group being of sufficient size so that it, alone or together with other such groups, makes the compound non-diffusive. Car, by an alkaline redox reaction is capable of releasing a diffusible dye or the precursor thereof from the above compound. R represents a hydrogen atom or an alkyl group having from 1 to 3 carbon atoms, $R^1$ represents

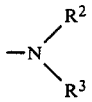

(wherein $R^2$ and $R^3$ are allowed to be either the same or different and each is a hydrogen atom, an alkyl having from 1 to 3 carbon atoms, a cycloalkyl, or an aryl group, and the $R^2$ and $R^3$ are allowed to form a saturated 5-member or 6-member cyclic ring by coupling through a carbon atom, an oxygen atom or a nitrogen atom), X represents hydroxyl group or a salt thereof or a group capable of becoming a hydroxyl group by hydrolysis, Y is

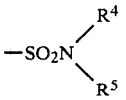

(wherein $R^4$ is an acyl group, a hydroxyalkyl group, an alkoxyalkyl group, an alkoxyalkyleneoxyalkyl group, a carboxyalkyl group, carboxyphenyl group, a carboxyalkyl-phenyl group, a hydroxyalkyl-phenyl group or an alkoxyphenyl group, and $R^5$ is a hydrogen atom, an alkyl or aryl group having from 1 to 8 carbon atoms or a group as defined in $R^4$, provided the sum of the number of the carbon atoms of $R^4$ and $R^5$ is not more than 10), m is an integer of 0 or 1, $J^1$ and $J^2$ are allowed to be either the same or different, and each represents a divalent group represented by $—R^6—(O)_n—R_p^7—$ (wherein $R^6$ and $R^7$ are allowed to be either the same or different, and each is an alkylene group or phenylene group having from 1 to 8 carbon atoms or a phenylene group substituted by methoxy, methyl group or a chlorine atom and n is an integer of 0 or 1, p is 1 when n is 1, and is 1 or 0 when n is 0, provided when p is 1, the sum of the number of the carbon atoms contained in $R^6$ and $R^7$ is not more than 13).

DETAILED DESCRIPTION OF THE INVENTION

The most characteristic alkyl group in the present invention having from 1 to 3 carbon atoms represented by the R in the foregoing Formula (I) includes, e.g., methyl, ethyl and propyl groups; the alkyl group having from 1 to 3 carbon atoms represented by each of the $R^2$ and $R^3$ in the

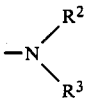

represented by the $R^1$ includes, e.g., methyl, ethyl and propyl groups, and the cycloalkyl group includes, e.g., cyclopentyl, cyclohexyl, and the like groups, and further the aryl group includes, e.g., phenyl, naphthyl, and the like groups; and the 5-member or 6-member cyclic ring formed through a carbon atom, an oxygen atom, or a nitrogen atom by the coupling of the $R^2$ with the $R^3$ includes cyclopentane, cyclohexane, and the like groups.

The Y in Formula (I), as earlier mentioned, represents

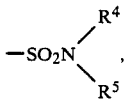

in which the acyl group represented by the $R^4$ includes, e.g., acetyl, propionyl, butyryl, caproyl, and like groups; the hydroxyalkyl group includes, e.g., hydroxymethyl, hydroxyethyl, hydroxypropyl, hydroxyhexyl, and like groups; the alkoxyalkyl group includes, e.g., methoxyethyl, methoxypropyl, ethoxyethyl, ethoxypropyl, and like groups; the alkoxyalkyleneoxyalkyl group includes, e.g., methoxyethyleneoxyethyl, ethoxyethyleneoxyethyl, and like groups; and further, the carboxyalkyl group includes, e.g., carboxymethyl, carboxyethyl, carboxypropyl, and like groups; the carboxyphenyl group includes, e.g., 4-carboxyphenyl; the carboxyalkyl-phenyl group includes, e.g., 4-carboxymethyl-phenyl group; the hydroxyalkylphenyl group includes, e.g., hydroxymethyl-phenyl, hydroxyethylphenyl, hydroxypropyl-phenyl, 2-hydroxypropyl-phenyl, and like groups; and the alkoxyphenyl group includes, e.g., methoxyphenyl, ethoxyphenyl, propoxyphenyl, isopropoxyphenyl, and like groups.

The alkyl group having from 1 to 8 carbon atoms represented by the foregoing $R^5$ is preferably an alkyl having from 1 to 4 carbon atoms, such as methyl, ethyl, propyl, and butyl groups; and the aryl group includes preferably phenyl, benzyl, naphthyl, and like groups, and also includes preferably the same groups as represented by $R^4$.

Further, the hydroxyl group or a salt thereof or the group capable of becoming hydroxyl group by hydrolysis, represented by the X in Formula (I), includes preferably hydroxyl, as well as acetoxy, chloroacetoxy, trifluoroacetoxy, benzoyloxy, and like groups.

In the foregoing Formula (I), of $-J^1-(-SO_2NR-J^2-)_m$, the group which couples the dye portion with the carrier portion, when m is zero, $J^1$ represents a divalent group selected from

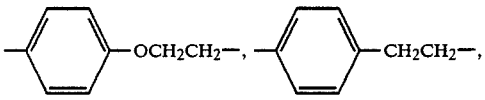

$-CH_2CH_2CH_2-$, and the like, and when m is 1, $J^2$ represents

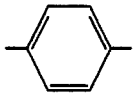

and $J^1$ represents a divalent group selected from

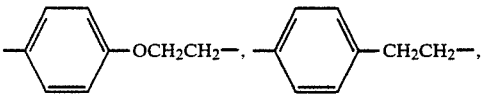

$-CH_2CH_2CH_2-$, and the like.

Further, the Car in Formula (I) represents the Car component capable of releasing a diffusible dye by development under alkaline conditions. As the Car component in the present invention, those of the prior art may be arbitrarily used, and examples of the Car group of the present invention have the formula:

Formula (II)

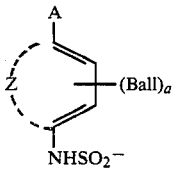

wherein Ball represents an organic ballasting group having such a number of carbon atoms as capable of making the compound nondiffusible during the course of development in an alkaline processing composition (the ballasting group will be described in detail hereinafter); Z represents an atomic group necessary to form a benzene ring, naphthol ring, or a heterocyclic ring such as pyrazolone, pyridine, or the like; A represents $OR^8$ or $NHR^9$ (wherein $R^8$ is a hydrogen atom or a group which is hydrolyzed to give hydroxyl group, and $R^9$ is a hydrogen atom or an alkyl group having from 1 to 20 carbon atoms, such as, e.g., methyl, octyl, dodecyl, octadecyl, or the like, the alkyl being also capable of acting as Ball independently); and a is an integer of up to 2.

The following are examples of the Car group having Formula (II):

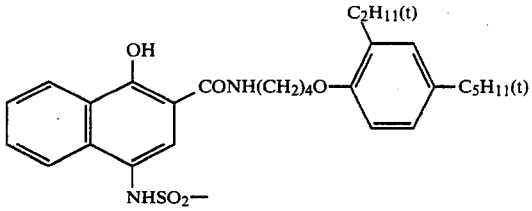

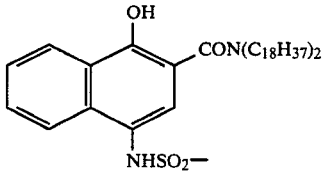

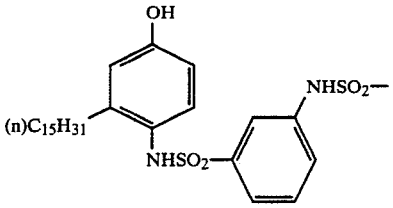

Car groups of this kind are described in detail in Japanese Patent O.P.I. Publication Nos. 33826/1973 and 50736/1978. As other preferred Car groups, there are those having the formula:

Formula (III)

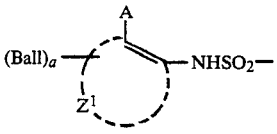

wherein Ball, $Z^1$, A and a are same as Ball, Z, A and a defined in Formula (II) respectively, and examples of those Car groups having Formula (III) are as given below:

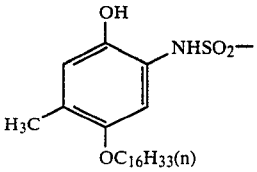

-continued

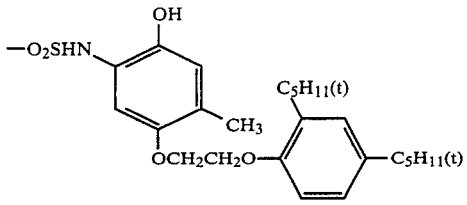

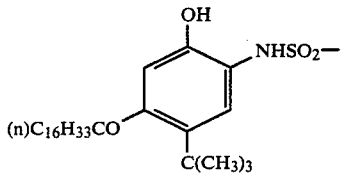

Car groups of this kind are described in detail in Japanese Patent O.P.I. Publication Nos. 104343/1976, 4673/1978 and 16131/1981, and U.S. Pat. No. 4,053,312.

As further Car groups, there are those having the formula:

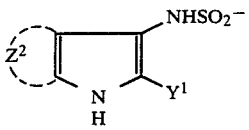

Formula (IV)

wherein $Y^1$ is preferably a hydrogen atom, an alkyl group such as methyl, ethyl, or like group; an aryl group such as, e.g., phenyl group; a heterocyclic group such as, e.g., oxazole group or the like; or —CO—$G^1$ [wherein $G^1$ is —$OG^2$—$SG^2$ or

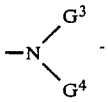

(wherein $G^2$ is a hydrogen atom, an alkyl group such as, e.g., methyl group, a cycloalkyl group such as cyclohexyl group, or an aryl group such as phenyl group; $G^3$ is the same group as defined in $G^2$ or an acyl group derived from aliphatic or aromatic carboxylic acids or sulfonic acid; $G^4$ is a hydrogen atom or an alkyl group such as methyl, butyl, or the like group)]; $Z^2$ is a residue necessary to complete the condensed benzene ring, the condensed benzene ring being allowed to have not less than one substituent, and the condensed benzene ring completed by $Z^2$ and/or $Y^1$ have a ballasting group as a substituent.

The following are examples of the Car group having Formula (IV):

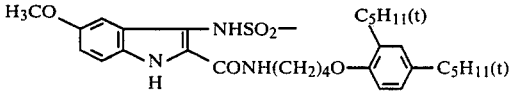

-continued

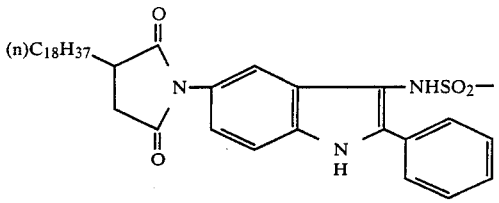

Car groups of this kind are described in detail in, for example, Japanese Patent O.P.I. Publication Nos. 104343/1976, 46730/1978 and 85055/1982.

As still further Car groups, there are those having the formula:

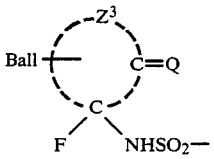

Formula (V)

wherein Ball is as defined in Formula (II), Q represents an oxygen atom or $NQ^1$ (wherein $Q^1$ is hydroxyl group or amino group), $Z^3$ is a saturated or unsaturated 5-member to 7-member cyclic nonaromatic hydrocarbon, the cyclic hydrocarbon being allowed to be fused at an appropriate position thereof with an aromatic hydrocarbon or heterocyclic ring; and F represents a hydrogen atom or a halogen atom, such as a fluorine atom, chlorine atom or bromine atom.

Car groups of this type include the following examples:

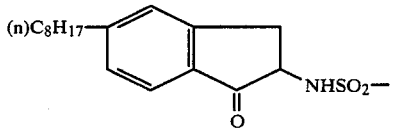

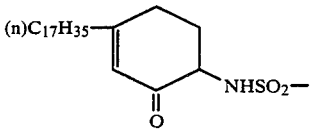

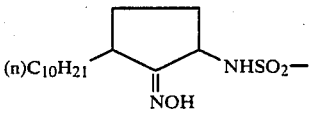

Car groups of this kind are described in detail in, for example, Japanese Patent O.P.I. Publication No. 3819/1978.

Those compounds which react with an oxidized or unoxidized developing agent or electron transfer agent under an alkaline developing condition to release dyes are known as dye-releasable redox (DRR) compounds to those skilled in the art.

The "Ballast" is an organic ballasting group having such a molecular size and three-dimensional configuration as to make the C.P.M. unable to diffuse into the photographic element during the development with an alkaline processing composition, and it is desirable to be a group comprising a hydrophobic group having from 8 to 32 carbon atoms.

Such an organic ballasting group links directly with or through a linkage group (e.g., single or combined linkage group of imino linkage, ether linkage, thioether linkage, carbonamido linkage, sulfonamido linkage, ureido linkage, ester linkage, imido linkage, carbamoyl linkage, sulfamoyl linkage, or the like) with C.P.M. The following are examples of the ballasting group:

Alkyl groups and alkenyl groups, such as, e.g., dodecyl group, and octadecyl group; alkoxyalkyl groups such as, e.g., 3-(octyloxy)propyl group and 3-(2-ethylundecyloxy)propyl group as described in Japanese Patent Examined Publication No. 27563/1964; alkyl-aryl groups such as, e.g., 4-nonyl-phenyl group and 2,4-di-tert-butyl-phenyl group; alkyl-aryloxyalkyl groups such as, e.g., 2,4-di-tert-pentylphenoxymethyl group, α-(2,4-di-tert-pentylphenoxy)propyl group, 1-(3-pentadecylphenoxy)ethyl group, and the like; acylamidoalkyl groups such as, e.g., 2-(N-butylhexadecaneamido)ethyl, and the like, as described in U.S. Pat. Nos. 3,337,344 and 3,418,129; alkoxyaryl and aryloxyaryl groups such as, e.g., 4-(4-n-dodecyl-phenyloxy)phenyl group, and the like; residual groups having both long-chain aliphatic alkyl or alkenyl group and water-solubilizing carboxy or sulfo groups, such as 1-carboxymethyl-2-nonadecenyl group, 1-sulfoheptadecyl group, and the like; ester-substituted alkyl groups such as, e.g., 1-ethoxycarbonyl heptadecyl group, 2-(n-dodecyloxycarbonyl)ethyl group, and the like; aryl group- or heterocyclic group-substituted alkyl groups such as, e.g., 2-[4-(3-methoxycarbonyl-uneicosaneamido)phenyl]ethyl group, 2-[4-(2-n-octadecylsuccinimido)phenyl]ethyl group, and the like; and aryloxyalkoxycarbonyl-substituted aryl groups such as 4-[2-(2,4-di-tert-pentyl-phenoxy)-2-methyl]-propyloxycarbonyl group, and the like.

As another preferred example of the present invention there is a C.P.M. capable of releasing a diffusible dye as the inverse function of the development of a silver halide emulsion layer under an alkaline condition. This is what is generally called the positive image-forming dye releasable compound. As the effective Car group in such compounds there are those having the formula:

Formula (VI)

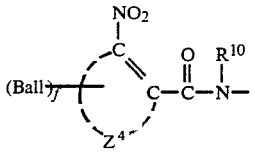

wherein Ball is as defined in Formula (II); $Z^4$ represents an atomic group necessary to form a benzene ring; $R^{10}$ is an alkyl group having from 1 to 4 carbon atoms, such as methyl, ethyl, propyl, butyl, or the like and F is 1 or 2.

The following are examples of the Car group having Formula (VI):

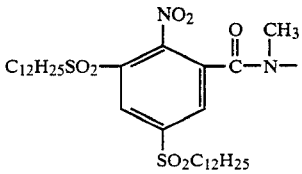

-continued

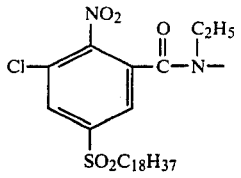

Other examples of Car groups of this kind are described in detail in Japanese Patent O.P.I. Publication No. 35533/1978.

Other Car groups of this kind have the formula:

Formula (VII)

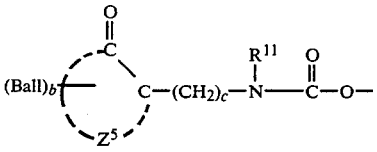

wherein Ball is as defined in Formula (II); $Z^5$ represents a quinone ring; $R^{11}$ is an alkyl having from 1 to 40 carbon atoms, such as, e.g., methyl, octyl, dodecyl, octadecyl, or the like group; b is an integer of 0 or 1, provided b is 1 when $R^{11}$ is an alkyl having not more than 8 carbon atoms; and c is an integer of 0 or 1.

The following are examples of the Car group having the above Formula (VII):

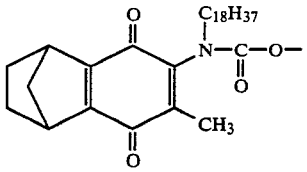

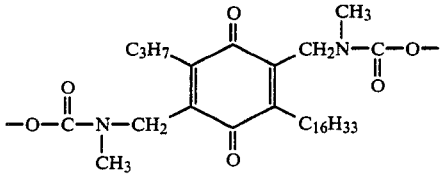

Detailed descriptions of examples of Car groups of this kind are found in Japanese Patent O.P.I. Publication No. 110827/1978.

As still further Car groups there are those having the formula:

Formula (VIII)

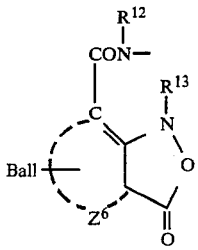

wherein Ball is as defined in Formula (II); $Z^6$, $R^{12}$ and $R^{13}$ are the same groups as the $Z^4$ and $R^{10}$, respectively, as defined in Formula (VI) and $R^{13}$ can also be benzyl.

The following are examples of such Car groups:

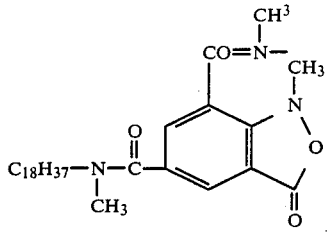

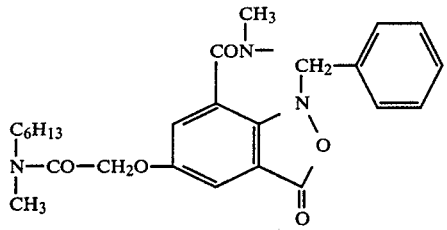

Car groups of this kind are described in detail in Japanese Patent O.P.I. Publication No. 111628/1974.

As still further Car groups there are those having the formula:

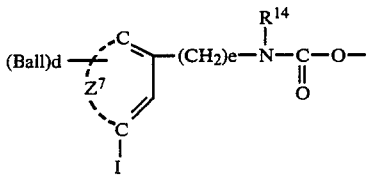

Formula (IX)

wherein Ball is as defined in Formula (II); $R^{14}$ is the same as $R^{11}$, defined in Formula VII); $Z^7$ is a sufficient number of atoms to complete a hydroquinone ring; d and e are the same as b and c, respectively, defined in Formula (VII), and I is hydroxyl group or a precursor that is hydrolyzed to become hydroxyl group. The following are examples of the compound having the above Formula (IX):

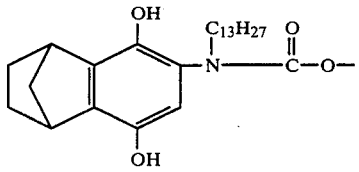

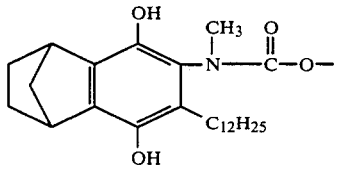

Car groups of this kind are described in detail in Japanese Patent O.P.I. Publication No. 6318/1976.

Still further preferred Car groups are those having the formula:

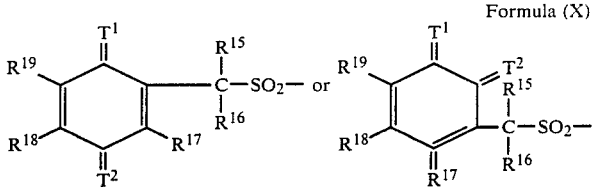

Formula (X)

wherein $T^1$ and $T^2$ each represent an oxygen atom or imino group, $T^1$ and $T^2$ being either the same or different from each other; $R^{15}$ and $R^{16}$ each is a hydrogen atom or an alkyl group such as methyl, octyl, dodecyl, octadecyl, or like group; $R^{17}$, $R^{18}$ and $R^{19}$ each is a hydrogen atom, a halogen atom such as a chlorine atom, an alkyl group such as methyl, octyl, dodecyl, or the like group, an alkoxy group such as methoxy, octyloxy, or like group, or an acylamino group such as benzoylamino group, provided adjacent two of $R^{17}$, $R^{18}$ and $R^{19}$ are allowed to form a condensed ring, and at least one group of $R^{15}$ through $R^{19}$ is a ballasting group as defined in Formula (II).

The following are examples of the Car group having the above Formula (X):

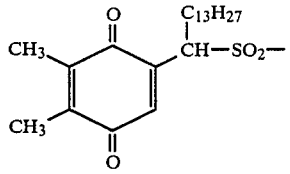

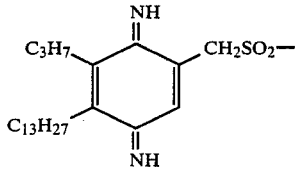

Car groups of this kind are described in detail in Japanese Patent O.P.I. Publication No. 130927/1979.

As the Car group used in still different positive image-forming dye-releasable compounds capable of releasing different dyes by being reduced under an alkaline condition, there are those having the formula:

$$[Me(Lig^1)_v(Lig^2)_q(Lig^3)_r(Lig^4)_s](B)_t \qquad \text{Formula (XI)}$$

wherein Me is a transition metal such as, e.g., Ni, Co; $Lig^1$ and $Lig^2$ each is a multidentate ligand; $Lig^3$ and $Lig^4$ each is a coordinatable ligand; B is a counter ion; v is an integer of from 1 to 3; q is an interger of up to 2 (provided when q is zero, v is an integer of at least not less than 2); r and s each is an integer of up to 4; and t is an integer of up to 6. Those compounds having Formula (XI) are described in detail in Japanese Patent O.P.I. Publication No. 183573/1980.

Any of the foregoing positive image-forming compounds having Formulas (VI) through (XI) may be incorporated into the photographic element as in the case of the previously mentioned other C.P.M.s.

The compounds having the above Formulas (VI) through (XI) are reduced by the action of a silver halide developing agent under alkaline conditions to release a diffusible dye or a dye-forming precursor thereof. A conventional negative silver halide emulsion, as well as a direct positive type emulsion, may be used.

Preferred cyan dyes released from the carrier component by the oxidation or reduction thereof under an alkaline condition have the formula:

Formula (XII)

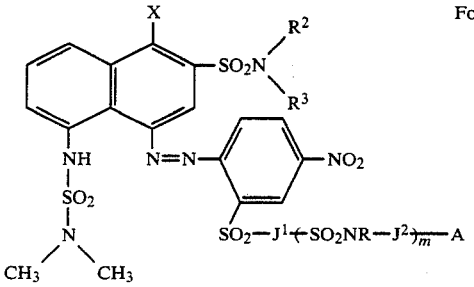

wherein R, X, $J^1$, $J^2$, $R^2$, $R^3$ and m represent the same groups and integer, respectively, as defined in Formula (I); A is $-SO_2NH_2$, $-NHR^{10}$, —OH, $-NHR^{12}$ or $-SO_2NH$ (wherein each of the $R^{10}$ and the $R^{12}$ of $-NHR^{10}$ and $-NHR^{12}$ is an alkyl group having from 1 to 4 carbon atoms).

Those compounds having the above Formula (XII) can be released from those carrier components having Formulas (II) through (XI) by the reaction as disclosed in Japanese Patent O.P.I. Publication Nos. 33826/1973 and 110827/1978.

The following are typical examples of the cyan C.P.M. having Formula (I) in the present invention, but the present invention is not limited thereto.

Exemplified Compounds:

(1)

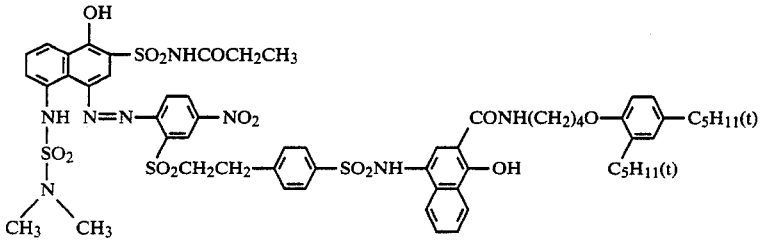

(2)

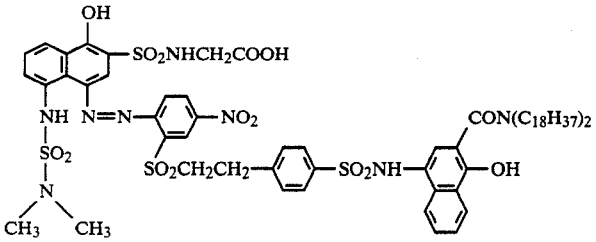

(3)

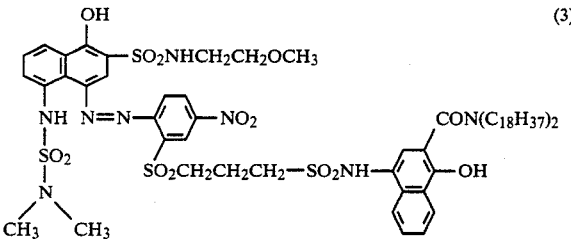

(4)

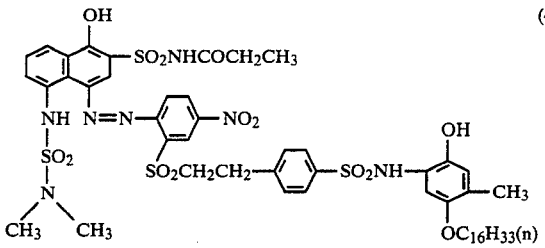

(5)

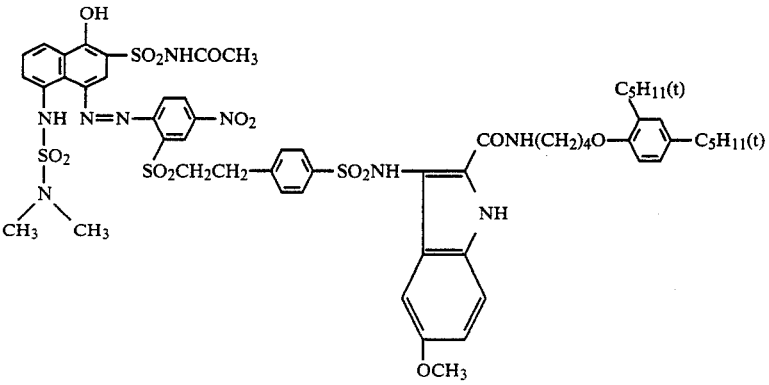

-continued
(6)
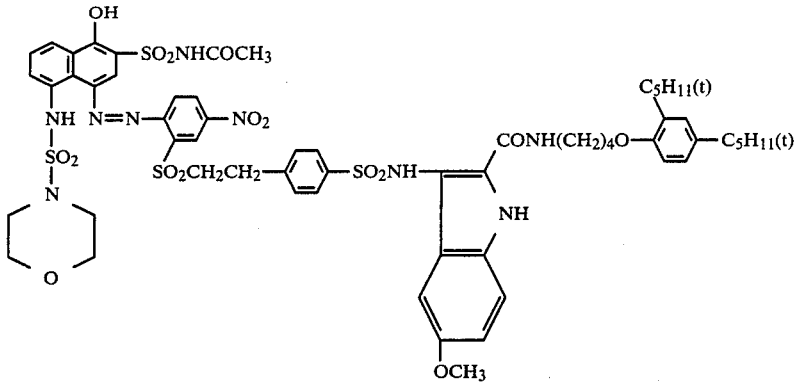
(7)
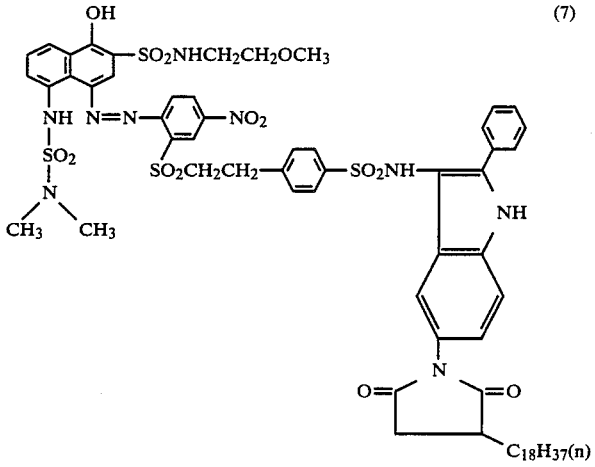
(8)
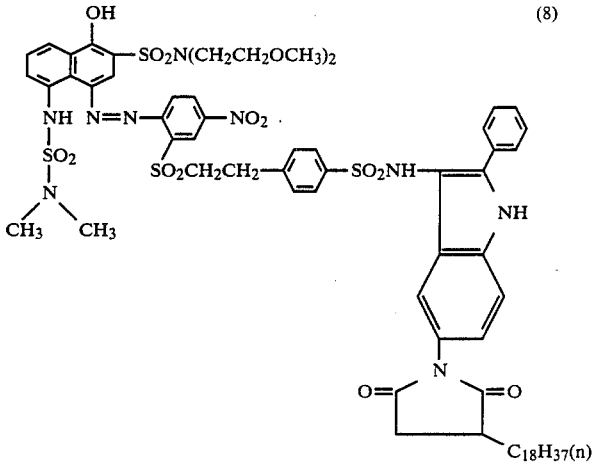
(9)
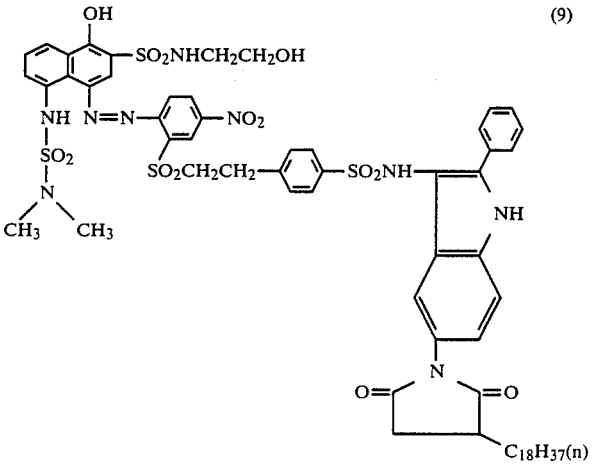
(10)
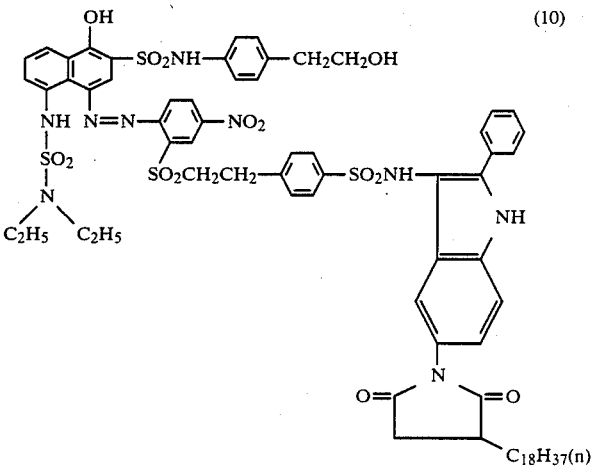

-continued
(11)
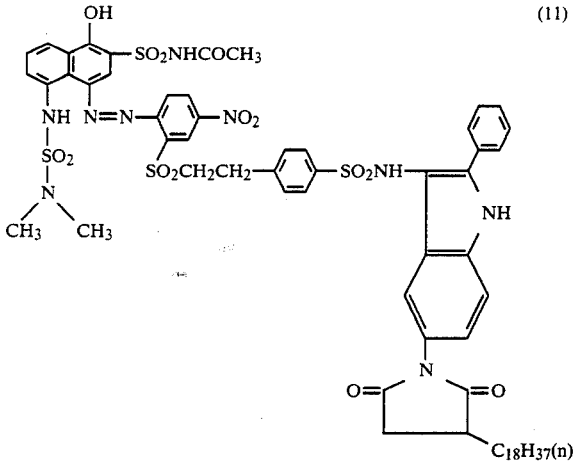
(12)
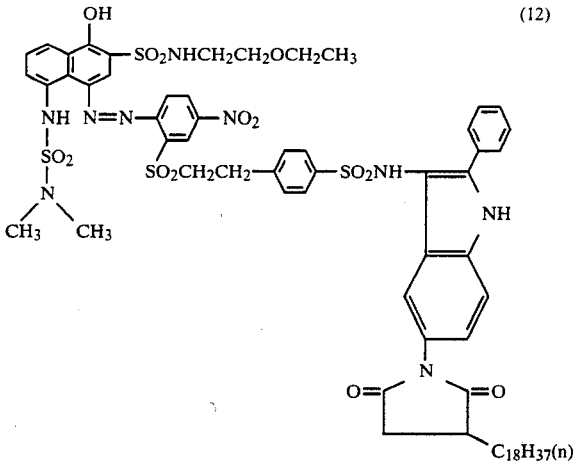
(13)
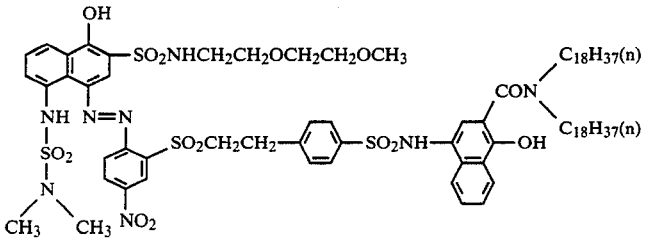
(14)
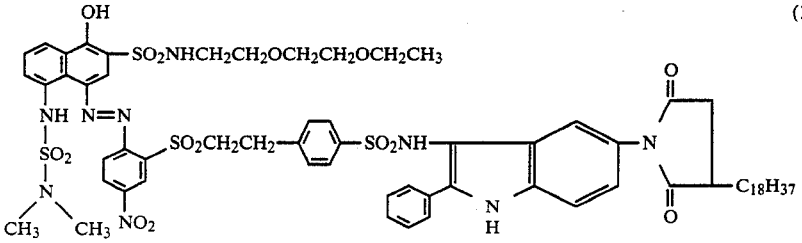
(15)
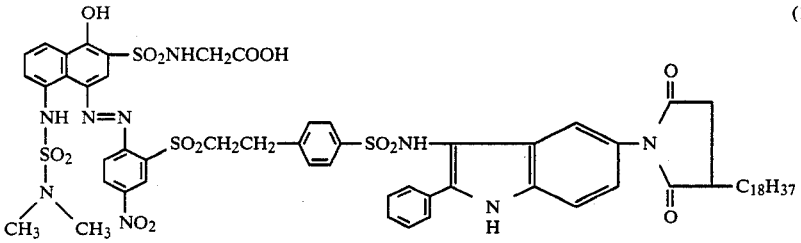
(16)
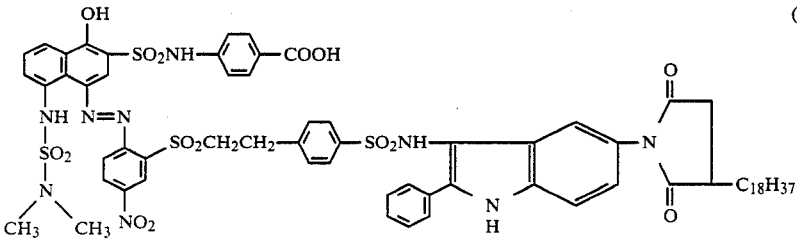

-continued
(17)
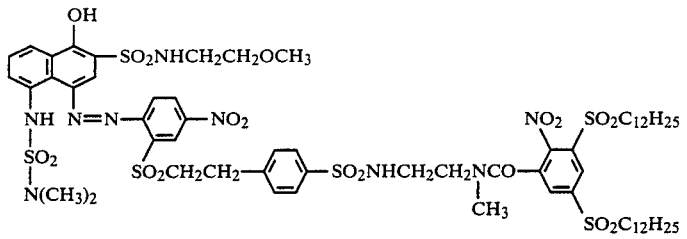
(18)
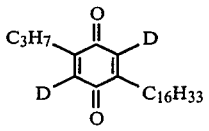
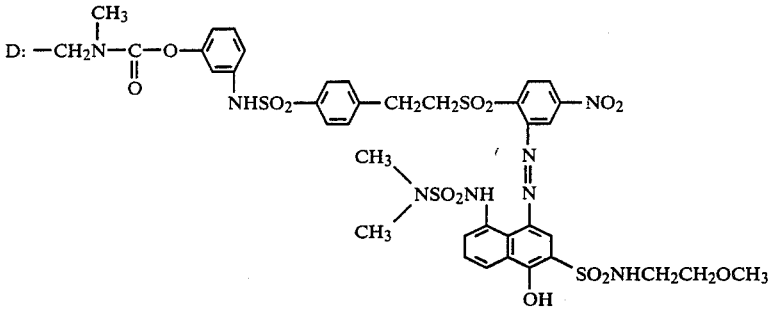
(19)
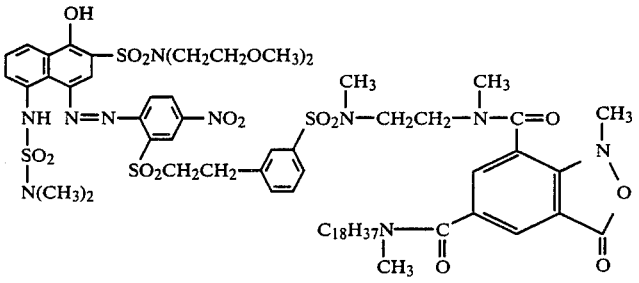
(20)
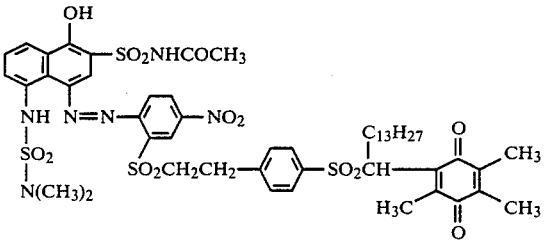
(21)
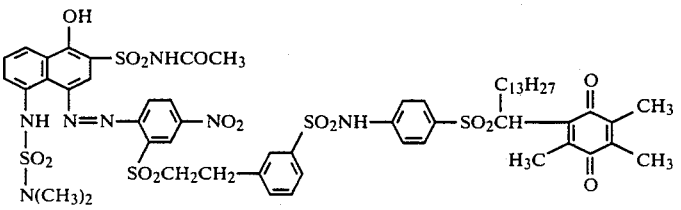

-continued (22)

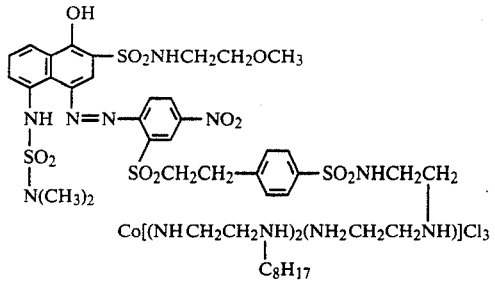

The preferred photographic light-sensitive element of the present invention has, on the support thereof, a red-sensitive silver halide emulsion layer having a cooperative relation with a cyan or shifted cyan C.P.M., a green-sensitive silver halide emulsion layer having a cooperative relation with a magenta or shifted magenta C.P.M., and a blue-sensitive silver halide emulsion layer having a cooperative relation with a yellow or shifted yellow C.P.M. In the element, the above cyan C.P.M. is the compound of the present invention.

One method of making a color photographic transfer image using of the photographic light-sensitive element of the invention comprises:

(1) The multilayered light-sensitive element, after being imagewise exposed, is processed with an alkaline processing composition in the presence of a silver halide developing agent to develop the exposed area of the silver halide emulsion layers. The developing agent is thereby oxidized, and this oxidized developing agent cross-oxidizes with the C.P.M.s.

(2) As a result of the imagewise exposure of the respective silver halide emulsion layers, imagewise-distributed diffusible dyes are formed.

(3) To produce an image, the imagewise-distributed diffusible dyes diffuse into a dye image-receiving layer, and (4) the image receiving layer having the dye image thereon is then arbitrarily peeled apart from the light-sensitive element.

In the above process, the light-sensitive element is developed or developing is begun in an arbitrary manner, so that it can be processed with an alkaline processing composition.

U.S. Pat. Nos. 2,983,606, 3,485,628 and 3,907,563 disclose the processing of the light-sensitive element by immersing it in a viscous alkaline processing liquid for a specified period of time, taking it out of the liquid, and then superposing it upon an image-receiving layer. The preferred means for the application of the viscous processing composition is a rupturable container or pod containing the above composition. Generally, the processing composition used in the present invention contains a developing agent for use in development. However, where the developing agent is incorporated in either the light-sensitive material or the image receiving layer, the composition is allowed to be a plain alkaline liquid. In this instance, the alkaline liquid serves to activate the developing agent contained in the light-sensitive element or image receiving layer.

Processing apparatus utilizing a non-viscous processing composition comprising a low-viscosity aqueous alkaline material is described in, e.g., U.S. Pat. No. 4,223,991.

The present invention further provides a photographic film unit designed so as to pass between a pair of juxtaposed pressure-applying members in the processing of the unit. This film unit comprises (1) the above photographic element, (2) a dye image receiving layer, and (3) means to squeeze out the alkaline processing composition inside the film unit.

The dye image-receiving layer inside the above unit may be provided on a separate support so that it, can be superposed on the light-sensitive element after an exposure. Such an image-receiving layer is generally known, which is described in, e.g., U.S. Pat. No. 3,362,819. In the case where means to squeeze out a processing composition is a rupturable container, generally, the container is arranged between the light-sensitive element and the image-receiving layer. A squeezing force is applied to the container with pressure-applying members to squeeze out and spread the content of the container between the outermost layers of the image-receiving layer and of the light-sensitive element. Such a processing system as the above may be designed so that the processing is accomplished inside a camera.

After the processing, the dye image-receiving layer is peeled away from the light-sensitive element. The dye image-receiving layer inside the above film unit may also be provided so as to be integrated with a light-sensitive silver halide emulsion layer. Such an integrated image-receiving element-negative-type light-sensitive element unit is disclosed in U.S. Pat. No. 3,415,644. An example of this type comprises a light-sensitive element provided on an opaque support and an image-receiving layer provided on a separate transparent support that is located furthest from the opaque support. A film unit of this type has on the transparent support thereof, in order, preferably a neutralizing layer, timing layer, and then the dye image-receiving layer. The light-sensitive element, after being exposed to light, is superposed on the image-receiving layer coated on a transparent support with a rupturable container therebetween, the container containing an alkaline composition containing a reflective agent such as, e.g., $TiO_2$. The container is ruptured by the pressure-applying members provided inside a camera, and when the film unit is drawn out from the camera, the processing composition is spread over the light-sensitive element. The spread processing composition develops the light-exposed silver halide emulsion layer, whereby a dye image is formed. The dye is then diffused into the image receiving layer, and a resulting image, with the opaque reflective layer as a background, can be observed through the transparent support.

The light-sensitive element comprising an opaque support coated thereon with a neutralizing layer, timing layer and a single light-sensitive layer or a plurality of light-sensitive layers is disclosed in U.S. Pat. No. 3,573,043.

Further useful integrated film units for which the compound of the present invention is usable are described in U.S. Pat. Nos. 3,594,164, 3,594,165, 3,647,437 and 3,635,707.

The photographic light-sensitive element of the present invention can be used not only for the color diffusion transfer processes but also for ordinary color photographic processes. That is, after the processing of the above light-sensitive element and the image transfer, the imagewise distribution of the dye or dye-formable material as well as the developed silver can remain inside the element. If the residual silver and the silver halide are removed in an ordinary manner, e.g., in a bleach bath and then fixed in a fix bath, or in a bleach-fix bath, a color image consisting of residual non-diffusible compounds is obtained inside the element. The imagewise distribution of the dye or dye-formable material may also be diffused out from the element into these baths rather than remain inside the element.

If a negative-type silver halide emulsion is used inside a certain preferred light-sensitive element, positive images, for example, reflective prints, color transparencies, or movie films, may be produced by this method. If a direct positive-type silver halide emulsion is used in such a light-sensitive element, negative color images can be produced.

The term "color" used herein includes the so-called "black-and-white color." Accordingly, the light-sensitive material of this invention can be used advantageously in radiography.

The film unit in the present invention can be used in making monochromatic or multicolor positive images. In a three-color system, the respective silver halide emulsion layers of a film material have cooperative relations with the C.P.M.s having principal spectral absorptions within the visible spectral regions to which the above respective emulsions are sensitive. That is, the blue-sensitive silver halide emulsion layer has an yellow C.P.M. having a cooperative relation therewith, the green-sensitive silver halide emulsion layer has a magenta C.P.M. having a cooperative relation therewith, and the red-sensitive silver halide emulsion layer has a cyan C.P.M. having a cooperative relation therewith.

The C.P.M. to be combined with each of the respective silver halide emulsion layers may also be incorporated into the corresponding silver halide emulsion layer, or may also be incorporated into a layer adjacent to the emulsion layer.

In the foregoing Formula (I), if the group represented by X is a hydrolyzable acyloxy group, the absorption spectrum of the azo dye is shifted toward relatively longer wavelength region. Dyes of this kind are called "shifted dyes," and the dye absorbs the light outside the region to which the silver halide emulsion layer combined with the dye is sensitive.

U.S. Pat. No. 3,307,947 describes the use of certain shifted azo dye developing agents in connection with the above.

The shifted C.P.M. of the present invention may be advantageously incorporated into the silver halide emulsion layer without deteriorating the speed of the emulsion layer.

The above acyloxy group is hydrolyzed by an alkaline processing composition to thereby release a desired hue-providable cyan dye.

The concentration of the compound, preferably alkali-cleavable by oxidation, used in the present invention may be changed over a wide range according to the specific compound used and the desired results. For example, the appropriate coating amount of the cyan C.P.M. of the present invention is from $1\times10^{-5}$ to $1\times10^{-2}$ mole/m$^2$, and preferably from $2\times10^{-4}$ to $2\times10^{-3}$ mole/m$^2$.

Dispersion of the cyan C.P.M. of the present invention into the light-sensitive element may be made by any of conventionally known various C.P.M. dispersion methods. Typical dispersion methods include:

(1) The cyan C.P.M. of the present invention is dissolved into a substantially water-insoluble, high-boiling solvent, and then finely dispersed into a hydrophilic protective colloid. Particularly useful high-boiling solvents include N-n-butylacetoanilide, diethyl-lauroylamide, dibutyl-lauroylamide, dibutyl phthalate, tricresyl phosphate, N-dodecyl-pyrolidone, and the like.

In order to facilitate the above dissolving, low-boiling or water-soluble organic solvents may be used. The low-boiling solvent includes ethyl acetate, methyl acetate, cyclohexanone, acetone, methanol, ethanol, tetrahydrofuran, etc.; the water-soluble organic solvent includes 2-methoxyethanol, dimethylformaldehyde, etc. These low-boiling solvents and water-soluble organic solvents can be removed by water or during the course of drying.

(2) The cyan C.P.M. of the present invention is dissolved into a water-miscible organic solvent, into which a fillable polymer latex and a sufficient amount of water to cause the cyan DRR compound in the solution to become insoluble is added slowly, whereby the cyan C.P.M. is incorporated into the fillable polymer latex particles.

The water-miscible organic solvent and the fillable polymer latex are described in detail in the foregoing Japanese Patent O.P.I. Publication Nos. 59942/1976 and 59943/1976.

(3) The cyan C.P.M. of the present invention is mechanically fine-grained by use of a sand grinder or a colloid mill, and then dispersed into a hydrophilic colloid.

(4) The cyan C.P.M. of the present invention is dissolved into a water-miscible organic solvent, and precipitated into water, preferably in the presence of a surfactant, and then the precipitate is dispersed into a hydrophilic colloid. This is the method described in, e.g., Japanese Patent O.P.I. Publication No. 139532/1978.

(5) The cyan C.P.M. of the present invention is dissolved together with a polymer into an aqueous alkaline solution, and the pH thereof is adjusted with use of an acid to thereby precipitate the cyan C.P.M. to be dispersed into a hydrophilic colloid.

The present invention allows the arbitrary use of various methods without being limited to the above-described methods.

The above hydrophilic protective colloid usable in the present invention includes, e.g., hydrophilic film-formable natural or synthetic polymer, such as, e.g., gelatin or polyvinyl alcohol (these suitably permit the permeation of an alkaline processing liquid), which is used as a dispersion medium of the cyan C.P.M. and coated to form a layer.

With respect to the compound of the present invention, various silver halide developing agents can be used in the invention. If the Car group used is any of those Car groups of Formulas (II)–(V), as long as the developing agent cross-oxidizes with the C.P.M. used, any silver halide developing agent can be used. The developing agent may also be used inside the light-sensitive element, in which case, it should be activated by an alkaline processing composition. Particular examples of the usable developing agents include hydroquinone, aminophenols such as, e.g., N-methylaminophenol, phenidone (1-phenyl-3-pyrazolidinone), dimezone (1-phenyl-4,4-dimethyl-3-pyrazolidinone), 1-phenyl-4-methyl-4-hydroxymethyl-3-pyrazolidinone, N,N-diethyl-p-phenylenediamine, 3-methyl-N,N-diethyl-p-phenylenediamine, and 3-methoxy-N,N-diethyl-p-phenylendiamine.

Among the above, black-and-white-type light-sensitive material developing agents are advantageous because they do not or only slightly stain the dye image-receiving layer. In the preferred example of the present invention, the silver halide developing agent used in the method according to the present invention is oxidized during development and concurrently reduces the silver halide into metallic silver. The oxidized developing agent cross-oxidizes the C.P.M. The cross-oxidized product subsequently undergoes alkali hydrolysis to thereby release a diffusible dye in an imagewise distribution. The resulting dye then diffuses into the image-receiving layer to produce a dye image.

In the color diffusion transfer process which uses any of the positive image-formable dye-releasable compounds having Formulas (VI) to (XI), the reducing agent is present as the inverse function of the silver halide development, and by the reaction between the reducing agent and a ballasted C.P.M. having any of Formulas (VI) to (XI) under alkaline conditions, a diffusible dye is released. The reducing agent (which reduces the C.P.M., i.e., an electron donor), and the precursor thereof such as benz-iso-oxazolones, $\beta$-diketones, saccharins, lactones, protohydroquinones, ascorbic acids, aminophenols, aminonaphthols, hydroquinones, or the like, are used in combination with the C.P.M. Such compounds are known from, e.g., Research Disclosure Nos. 19429 and 19507, and Japanese Patent O.P.I. Publication No. 138736/1981. Further, particularly favorable electron donators are described in Japanese Patent O.P.I. Publication No. 150846/1982.

In the case of using a negative image-formable dye releasable compound in accordance with the present invention, a negative-type or direct positive-type silver halide emulsion layer may be used. If the silver halide emulsion used forms a direct positive silver image, like a direct positive internal image emulsion or reversal emulsion, a positive image can be obtained in the dye image-receiving layer. After to light exposure to light of the film unit to light, an alkaline processing composition permeates into all the layers of the unit, and commences the development of the unexposed areas of the light-sensitive silver halide emulsion layers. The developing agent present inside the film unit (because the silver halide emulsion is of the direct positive type) develops the unexposed areas of the respective silver halide emulsion layers, so that the developing agent is oxidized imagewise corresponding to the unexposed areas of the direct positive-type silver halide emulsion layers. The oxidized developing agent subsequently cross-oxidizes the dye-releasable compound or, in the preferred example of the present invention, performs a base-catalytic reaction to imagewise release the dye according to the imagewise exposure of the respective silver halide emulsion layers. At least part of the imagewise distribution of the diffusible dye diffuses into the image-receiving layer, thus forming a positive image. After contact with an alkaline processing composition, a pH lowering layer lowers the pH of the film unit or of the image-receiving layer to stabilize the image. An internal latent image-type silver halide emulsion that forms a latent image principally inside the silver halide particles thereof is also useful as the direct positive emulsion; such an emulsion is described in Davey et al. U.S. Pat. Nos. 2,592,250 and 3,761,276.

The internal latent image-type silver halide emulsion, when processed in the presence of a fogging agent, directly yields a positive silver image. Examples of such fogging agents include those hydrazines as described in U.S. Pat. Nos. 2,588,982 and 2,563,785; those hydrazones as described in U.S. Pat. No. 3,227,552; those hydrazones as described in U.S. Pat. No. 3,615,615; quaternary salts; and those hydrazone-containing polymethine dyes as described in U.S. Pat. No. 3,718,470; and mixtures of these compounds.

Other direct positive silver halide emulsions useful for the above examples are such silver halide emulsions chemically fogged in advance by use of a reducing agent or fogged in advance almost up to the point of maximum potential density of reversal image by exposing to radiant light.

The above emulsions are described in pages 261–297 of "The Theory of The Photographic Process" by Mees (published by McMillan Co. N.Y. in 1942).

Typical methods for preparing such emulsions are described in U.S. Pat. Nos. 3,367,778, 3,501,305, 3,501,306 and 3,501,307.

Other examples for which the image formable compounds according to the present invention may be used include those techniques as described in U.S. Pat. Nos. 3,227,550, 3,227,551, 3,227,552 and 3,364,022.

Negative-type silver halide emulsions useful for certain examples of the present invention include, e.g., silver chloride, silver chlorobromide, silver iodobromide, silver chloroiodobromide emulsions and mixtures of these silver halide emulsions. These emulsions may be used in the coarse-grained or fine-grained form, and prepared in various manners of the prior art.

Such emulsions include, for example, single-jet emulsions as described by Trivelli & Smith in "The Photographic Journal" LXXIX, May 1939, pp. 330–358; double-jet emulsions, e.g., Lippmann emulsion, ammoniacal emulsion, and those emulsions ripened with use of thiocyanate or thioether, as described in U.S. Pat. Nos. 2,222,264, 3,320,069 and 3,574,628. These emulsions can also be monodispersed regular particle emulsions as described by Klein and Moisar in the "Journal of the Photographic Science" Vol. 12, No. 5, Sept./Oct. 1964, pp. 242–251.

Another example of the present invention uses the image reversing method disclosed in the 1st–41st lines in p. 19 of U.K. Pat. No. 904,364. In this system, the dye-providable compound of the present invention is used together with the physical development nucleus of the layer adjacent to the light-sensitive silver halide negative-type emulsion layer.

This film unit contains a silver halide solvent. The film unit is, preferably, provided with a rupturable container containing an alkaline processing composition.

The silver halide emulsion layers of a color film according to the present invention are coated in an ordinary order, i.e., from the incident light side in the order of a blue-sensitive silver halide emulsion layer, green-sensitive silver halide emulsion layer, and red-sensitive silver halide emulsion layer. However, the order may be changed according to desired purposes.

If necessary, a yellow dye layer or yellow colloidal layer may be interposed between the blue-sensitive silver halide emulsion layer and the green-sensitive silver halide emulsion layer.

The rupturable container used as part of the integrated film unit of the present invention is of the type as described in U.S. Pat. Nos. 2,543,161, 2,643,886, 2,653,732, 2,724,051, 3,056,492, 3,056,491 and 3,152,515.

In the color film unit according to the present invention, the respective C.P.M.-containing silver halide emulsion layers or the respective silver halide emulsion layers provided with their adjacent layers containing C.P.M. are separated from one another by any of a number of materials such as gelatin, calcium alginate, or those as described in U.S. Pat. No. 3,384,483, polymer materials such as polyvinylamide as disclosed in U.S. Pat. No. 3,421,892, or those as described in French Patent No. 2,028,236, and U.S. Pat. Nos. 2,992,104, 3,043,692, 3,044,873, 3,061,428, 3,069,263, 3,069,264, 3,121,011 and 3,427,158.

Generally speaking, the silver halide emulsion layer of the present invention is one produced by dispersing a light-sensitive silver halide into gelatin, having a thickness of about 0.6 to 6 microns. A dye image-providable material is dispersed into an aqueous alkaline solution-permeable polymer binder such as gelatin which, as a separating layer, has a thickness of about 1 to 7 microns. An alkaline solution-permeable polymer intermediate layer, such as of gelatin, has a thickness of about 1 to 5 microns. These thicknesses, of course, are approximate values, so that for commercial products, these thicknesses are allowed to be changed.

As long as it is a mordant or has a fixable function, any arbitrary material can be used as the image-receiving layer of the present invention. It goes without saying that selection of any particular material depends on the dye to be mordanted. The usable mordant includes such basic polymer mordants as, e.g., polymers of amonoguanidine derivatives of vinylmethyl ketone; those as described in, e.g., U.S. Pat. No. 2,882,156; and such basic polymer mordants as described in, e.g., U.S. Pat. Nos. 3,625,694, 3,709,690 and 3,898,088. In addition, the same are also described in U.S. Pat. Nos. 3,958,995 and 3,859,096, and Research Disclosure No. 15162 (1976).

Generally, as the image-receiving layer, satisfactory results are obtained by use of a transparent, alkaline solution-permeable image-receiving layer having a thickness of about 0.25–0.40 mil. The thickness is allowed to be changed according to desired results. The image-receiving layer may contain an ultraviolet absorbing agent to prevent possible discoloration of the mordanted dye image by ultraviolet rays, and further may contain a brightening agent such as, e.g., stilbene, coumarin, triazine, oxazole, or the like, and a dye stabilizer such as, e.g., chromanol, alkylphenol, or the like.

The stability of the transfer image may be generally increased by applying a pH lowering agent to the dye image-receiving portion of the film unit of the present invention. Generally, this pH lowering agent functions to rapidly lower the pH of the image layer after the imbibition thereof. For example, good results can be obtained by use of such polymer acids or solid acids or metallic salts as disclosed in U.S. Pat. No. 3,362,819, or zinc acetate, zinc sulfate or magnesium oxalate as disclosed in U.S. Pat. No. 2,584,030. Such pH lowering agents are capable of lowering the pH of the film unit during the period between the commencement of and completion of the development. Further, during the development period, it also substantially lowers the transfer rate of the dye to thereby stabilize the dye image.

If an inert timing layer or a spacer layer is used over the above pH lowering layer, the lowering of the pH can be delayed for the time necessary for the alkali to pass through the spacer layer to be diffused, i.e., the pH lowering speed can be controlled. As such a timing layer, gelatin, polyvinyl alcohol or any of those as disclosed in U.S. Pat. No. 3,455,686 may be arbitrarily used.

The timing layer is effective to even out the reaction rate which otherwise changes with temperature. For example, the timing layer, when the imbibition is made at a temperature higher than normal temperature, e.g., at a temperature between 35° C. and 38° C., prevents the speed up of the pH lowering.

The thickness of the timing layer is normally from 0.1 to 0.7 mil. A particularly satisfactory timing layer is comprised of a hydrolyzable polymer that is slowly hydrolyzed by a processing composition or of a collective of such polymers. Examples of such hydrolyzable polymers include polyvinyl acetates, polyamides and cellulose esters. Other examples of such timing layers and the functions thereof are described in detail in Japanese Patent O.P.I. Publication Nos. 54341/1980, 69629/1981, 6842/1982, 6843/1982 and 60332/1982, and Japanese Patent Application No. 65445/1981.

The alkaline processing composition for use in the present invention is a solution containing an alkaline material such as sodium hydroxide, sodium carbonate, etc., or an aqueous amine solution containing an amine such as diethylamine. The pH of the solution is preferably not less than 10. The solution preferably contains the foregoing developing agent.

This solution may also contain a viscosity-increasing compound such as a water-soluble ether that is inert to an alkaline solution, an alkali-metallic salt of hydroxyethyl cellulose or of carboxymethyl cellulose, or sodium carboxymethyl cellulose. The viscosity-increasing compound, in an amount of 1–5% by weight based to the processing composition, increases the viscosity of the processing composition to the preferred viscosity range of 100 cp cps–200,000 cp cps. In a certain example of the present invention, an opacifying agent such as, e.g., $TiO_2$, carbon black and/or a pH indicator dye may be added to the processing composition.

The alkaline processing composition usable in the present invention is packed in a rupturable container, whereby the processing composition can be conveniently incorporated into the film unit.

An alkali-permeable, substantially opaque light-reflective layer usable in a certain example of the film unit of the present invention is generally comprised of an arbitrary opacifying agent dispersed in a binder. The particularly preferred embodiment is a white light-reflective layer because it enables the transferred dye image to have a beautiful look, and it has an optically preferred nature for the reflection of the incident radiant light. The preferred opacifying agent is titanium dioxide, which may be dispersed into gelatin or polyvinyl alcohol.

Brightening agents such as stilbene, coumarin or oxazole may, if necessary, be added to the light-reflective layer. If the opacity of the light-reflective layer should be increased, a black opacifying agent such as, e.g., carbon black or nigrosine dye may be incorporated into a different layer adjacent to the above light-reflective layer.

The support material usable for the light-sensitive element and the image-receiving element is a flexible material in sheet form such as cellulose nitrate film; cellulose acetate film, poly(vinyl acetal) film, polystyrene film; poly(ethylene terephthalate) film, polycarbonate film; poly-α-olefin film such as, e.g., polyethylene or polypropylene film; or the like film; or resinous material or paper—preferably poly-α-olefin-coated paper.

The silver halide emulsion and the techniques relating thereto useful for the present invention are known to those skilled in the art. They are described in Research Disclosure No. 9232 (1971).

The term "nondiffusibility" used herein means the generally applied meaning to this photographic term. It is applied to materials which do not migrate or wander through an organic colloidal layer, such as, e.g., a gelatin layer, when the photographic element of the present invention is processed in an alkaline medium having a pH of preferably not less than 5. The term "diffusibility" has an opposite meaning to "nondiffusibility" above. "Diffusibility" is applied to materials having the ability to effectively diffuse through the colloidal layer of the photographic element in an alkaline medium.

Methods of producing compounds having Formula (I) will be described below:

SYNTHESIS OF EXEMPLIFIED COMPOUND 7

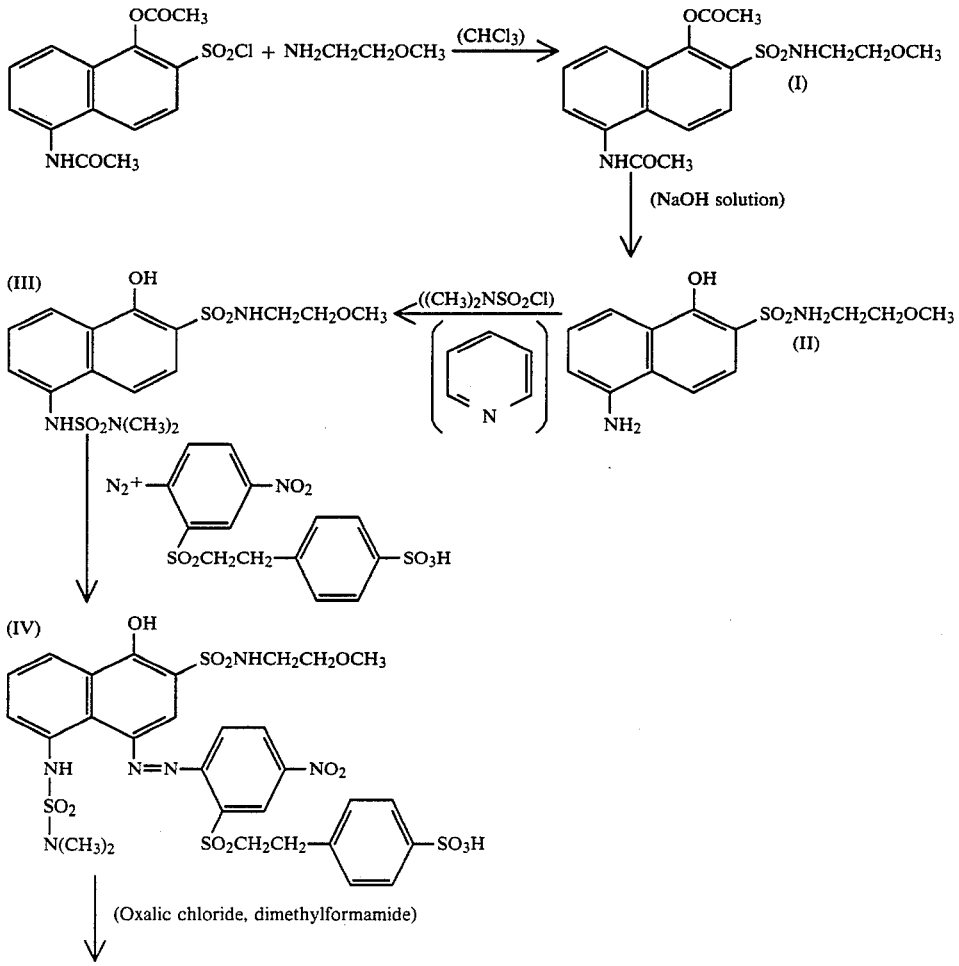

-continued

SYNTHESIS OF EXEMPLIFIED COMPOUND 7

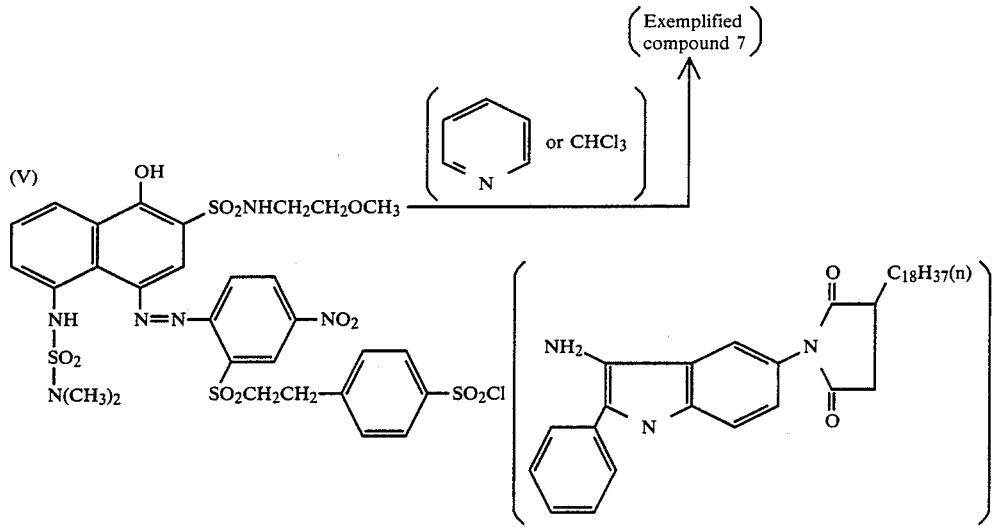

Synthesis of Intermediate [I]

200 g of β-methoxyethylamine are added to 1.3 liters of chloroform, and to the mixture are added 150 g of 5-acetylamino-1-acetoxy-2-chlorosulfonyl-naphthalene at a temperature of not more than 30° C. After the addition, the mixture is heated to 50° C. and stirred for a period of two hours, and then the solvent is distilled off under reduced pressure, whereby a solid is obtained.

Synthesis of Intermediate [II]

150 g of sodium hydroxide are dissolved into one liter of water, to which solution is added all the above-obtained Intermediate [I], and the mixture is refluxed by heating for a period of 6 hours. After natural cooling, the deposited crystals are filtered, and then dissolved into 2 liters of water, to which is dropwise added acetic acid to adjust the pH to 4. The deposited crystals are filtered, thereby obtaining an objective product. Yield: 120 g, Melting point: 111°-113° C.

Synthesis of Intermediate [III]

100 g of the above Intermediate [II] are dissolved into 800 ml of pyridine. 92 g of N,N-dimethylaminosulfonyl chloride are added to the solution dropwise at a temperature of from 20° to 30° C. The mixture is stirred over a period of 24 hours at room temperature and 100 ml of water are added thereto. After a further two-hour stirring, the mixture is poured into 5 liters of iced water containing one liter of hydrochloric acid; the deposited crystals are filtered and washed with two liters of water. The resulting crystals, after drying, are dissolved into 800 ml of chloroform; the partially undissolved substance is removed by filtering with diatomaceous earth, and the filtrate is concentrated to 400 ml. To the concentrated liquid 200 ml of n-hexane are added to deposit the crystals. The crystals are filtered and washed with a chloroform-n-hexane liquid (1:1) mixture, and then dried. Yield: 70 g, Melting point: 125°-126° C.

Synthesis of Intermediate [IV]

To 50 ml of concentrated sulfuric acid, 8.5 g of sodium nitrite are added in small amounts at a temperature of not more than 25° C. The mixture is heated to 70° C. and the heating is continued for 15 minutes. The mixture is then cooled, to which are added 100 ml of glacial acetic acid. 43 g of 2-(4-sulfophenethyl)ethylsulfonyl-4-nitroaniline (Japanese Patent O.P.I. Publication No. 33141/1980) are added, and the resulting solution is stirred for three hours at 10°-15° C. to homogenize the solution. The solution is then diluted, with cooling, by adding 100 ml of glacial acetic acid and 150 ml of iced water. A small quantity of urea is then added to decompose excess sodium nitrite, thereby producing a diazonium salt solution.

46 g of Intermediate [III] are dissolved into a liquid mixture of 300 ml of methanol with 50 ml of glacial acetic acid. To this, 20 g of potassium acetate and 50 ml of water are added to prepare a coupler solution. This coupler solution is cooled to 5°-10° C. The foregoing diazonium salt solution and 120 g of potassium acetate are added simultaneously, in small amounts, to carry out a diazo coupling. After the addition, the system is stirred for two hours at room temperature to deposit dye crystals, which are filtered and washed, first with glacial acetic acid and then with methanol, thereby obtaining the objective product. Yield: 130 g.

Synthesis of Intermediate [V]

25 g of Intermediate [IV] is dispersed into a mixture of 300 ml of acetonitrile with 40 ml of dimethylformamide. To the mixture, 35 g of oxalic chloride are added dropwise with cooling to maintain a temperature below 15° C. The liquid is stirred at a temperature of from 15° to 20° C. for an hour, and then poured into 2 liters of iced water to deposit crystals, which are subsequently filtered and sufficiently washed with cold water, and then dried under reduced pressure in a phosphorus pentaoxide desiccator. Yield: 17 g.

Synthesis of Exemplified Compound 7

11.2 g of 2-phenyl-3-amino-5-octadecylsuccinimidoindole (Japanese Patent O.P.I. Publication No. 85055/1982) is suspended in 200 ml of chloroform, to which are added 16 g of Intermediate [V] and 10 ml of pyridine are then slowly added dropwise. This mixture is refluxed by heating for 2 hours, and then 5 ml of water and 100 ml of methanol are added thereto. The resulting mixture is further refluxed for 3 hours, and subsequently heated under normal pressure to distill off the chloroform-methanol azeotropic mixture. In this instance, methanol should be added from time to time to keep at least 200 ml of solvent present. When the chloroform is completely substituted by methanol, 12 ml of concentrated hydrochloric acid are added to the system, which is then cooled. The deposited precipitate is filtered and washed with methanol and then with water. Subsequently, the solid is dissolved into ethyl acetate, and then isolated and refined by silica gel column chromatography. Yield: 13.2 g, Melting point: 195°–198° C.

SYNTHESIS OF EXEMPLIFIED COMPOUND 15

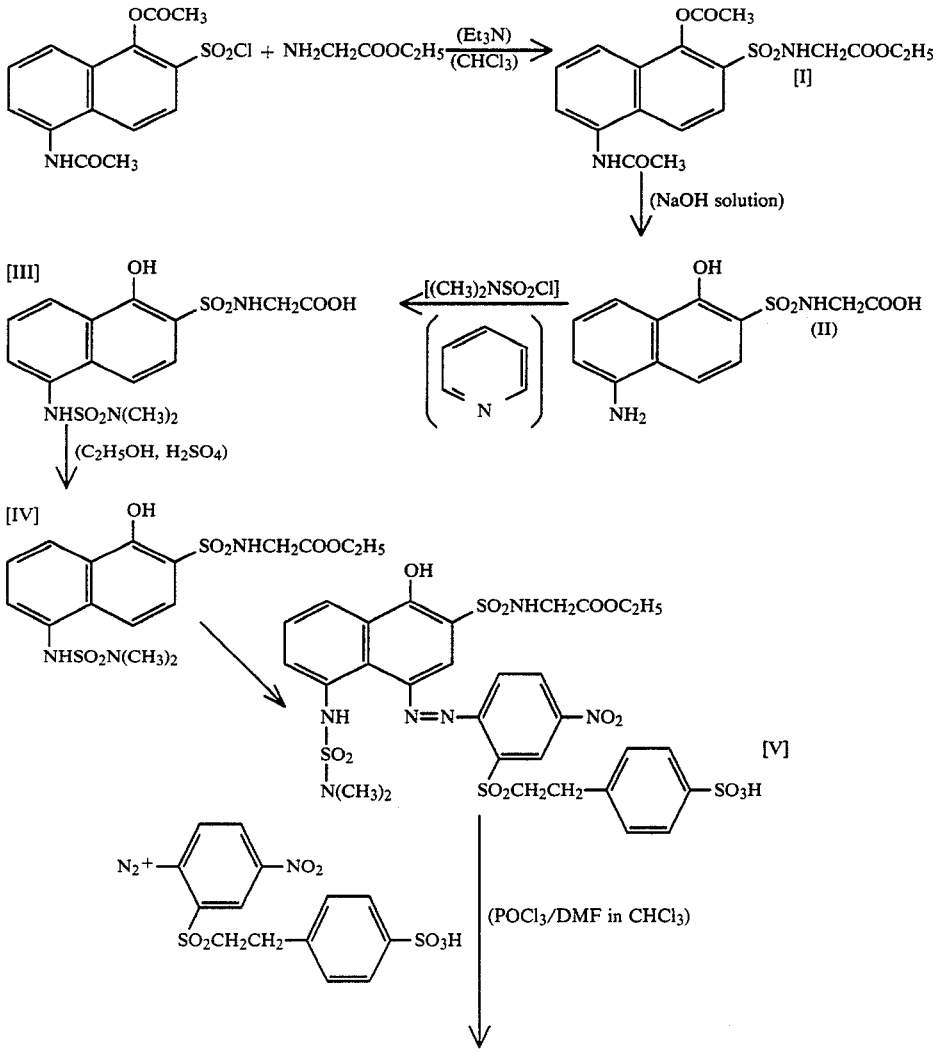

-continued

SYNTHESIS OF EXEMPLIFIED COMPOUND 15

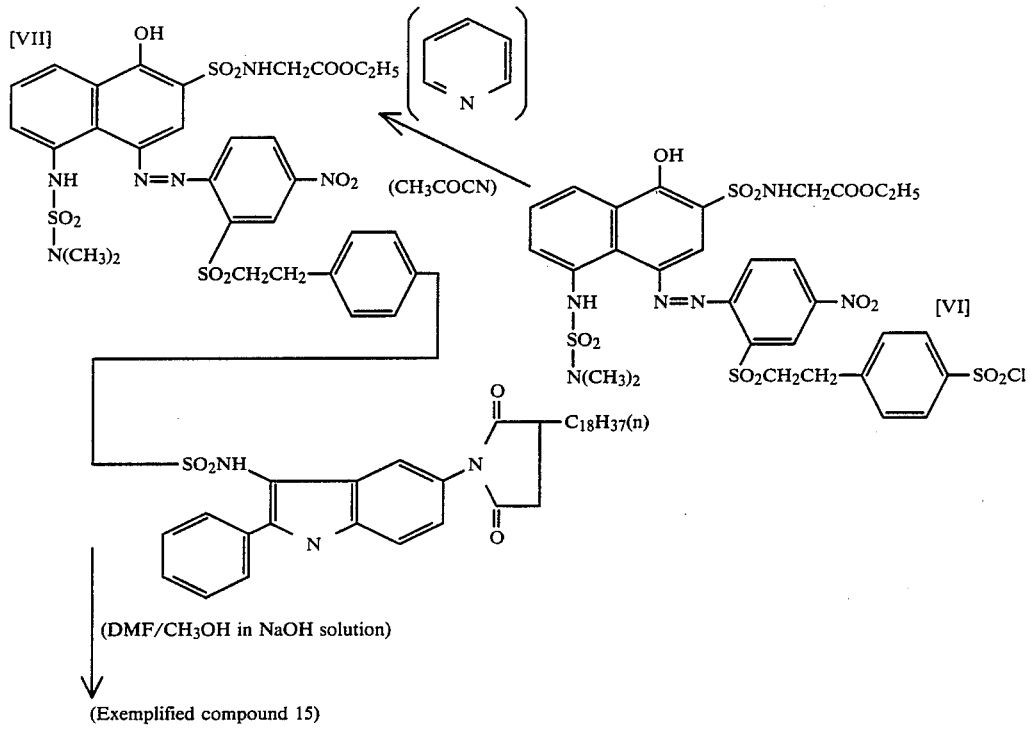

Synthesis of Intermediate [I]

To one liter of chloroform are added 12 g of glycine-ethyl hydrochloride and 110 g of triethylamine. To this are added 120 g of 5-acetylamino-1-acetoxy-2-chlorosulfonylnaphthalene at a temperature of not more than 30° C. After the addition, the reaction liquid is heated to 45°-50° C. for two hours, and then poured into 1.2 liters of iced water containing 60 ml of concentrated hydrochloric acid to thereby remove excess triethylamine in the hydrochloride form. The liquid is subsequently separated into a chloroform phase and water phase, and the chloroform is concentrated under reduced pressure, whereby 136 g of a solid are obtained.

Synthesis of Intermediate [II]

120 g of sodium hydroxide are dissolved into 0.8 liter of water and to the solution are added 122 g of the foregoing Intermediate [I]. The mixture is refluxed by heating for 6 hours. After natural cooling, the liquid is poured into ice water containing 250 ml of concentrated hydrochloric acid and 2 kg of ice. Acetic acid is added to adjust the pH to 4.0 to thereby deposit a precipitate. This precipitate is filtered and then dried at a temperature of not more than 50° C. Yield: 62 g, Melting point: 185°-189° C.

Synthesis of Intermediate [III]

60 g of Intermediate [II] are dissolved into 500 ml of pyridine, and 52 g of N,N-dimethylaminosulfonyl chloride are added dropwise, at 20° to 30° C. to the solution. The reaction takes place at 45°-50° C. for 6 hours. After completion of the reaction, the reaction liquid is poured into 2.5 liters of ice water containing 500 ml of concentrated hydrochloric acid, and the pH thereof is adjusted by use of acetic acid to 4.0, thereby obtaining a precipitate. The precipitate is filtered and then dried at a temperature of not more than 50° C. Yield: 58 g, Melting point: 140°-144° C.

Synthesis of Intermediate [IV]

550 ml of ethanol are cooled by ice. 55 ml of concentrated sulfuric acid are added to this solution in small amounts. 55 g of Intermediate [III] are added, and the mixture is then refluxed by heating for 8 hours. The reaction liquid, after being allowed to stand overnight, is poured into ice water containing potassium hydrogencarbonate, thereby obtaining a precipitate. The precipitate is filtered, washed with water, and then dried. Yield: 53 g, Melting point: 135°-139° C.

Synthesis of Intermediate [V]

8.1 g of sodium nitrite is added in small amounts at a temperature of not more than 15° C. to 52 ml of concentrated sulfuric acid. The mixture is dissolved by heating for 15 minutes at 60°-65° C. This is cooled and to it are added, at a temperature of not more than 25° C., 85 ml of glacial acetic acid 40.8 g of 2-(4-sulfophenethyl)ethylsulfonyl-nitroaniline (Japanese Patent O.P.I. Publication No. 33141/1980) are added at a temperature of 10°-15° C. This mixture is then stirred for three hours at 10°-15° C. to homogenize the solution. The solution is cooled and then diluted by the addition of 100 ml of glacial acetic acid and 150 ml of ice water. A small quantity of urea is added to decompose excess sodium nitrite, thereby preparing a diazonium salt solution.

43.1 g of Intermediate [IV] is dissolved into a mixture of 280 ml of methanol with 50 ml of acetic acid, and to it are added 20 g of potassium acetate and 50 ml of water, thereby preparing a coupler solution. Simultaneously, with cooling to 5° to 10° C. the above diazonium salt solution and 110 g of potassium acetate are added in small amounts to the coupler solution to thereby carry out a diazo-coupling reaction. After the addition, the reaction system is stirred at room temperature for two hours to deposit a dye. The deposited dye is filtered, washed with glacial acetic acid and then with methanol to thereby obtain the objective product. Yield: 133 g.

Synthesis of Intermediate [VI]

To 750 ml of chloroform are added 10.5 ml of N,N-dimethylformamide. The mixture is cooled to less than 10° C., and 13.2 ml of phosphorus oxychloride are added dropwise little by little. 50 g of Intermediate [V] is added in small amounts. After the addition, the mixture is stirred for three hours at about 45° C. Thin layer chromatography is used to make sure of the vanishing of Intermediate [V], and after that the liquid is cooled to 15° C. to deposit crystals. The crystals are filtered and washed with a dried, and cold chloroform twice then dried under reduced pressure. Yield: 47 g.

Synthesis of Intermediate [VII]

11.1 g of 2-phenyl-3-amino-5-octadecylsuccinimidoindole (Japanese Patent O.P.I. Publication No. 85055/1982) are suspended in 150 ml of dried acetonitrile, and to it are added 20 ml of pyridine and 32 g of Intermediate [IV]. The reaction of the liquid takes place at 40° C. for three hours. After completion of the reaction, the liquid is cooled to about 15° C. to deposit a precipitate. The precipitate is filtered off, and the filtrate is poured into 800 ml of ice water containing 22 ml of concentrated hydrochloric acid to deposit crystals. The crystals are filtered, washed with water, and then dried. The dried crystals are dissolved into chloroform, and isolated and refined by silica gel chromatography. Yield: 15.2 g.

Synthesis of Exemplified Compound 15

Into 200 ml of deoxidized N,N-dimethylformamide are dissolved 10.9 g of Intermediate [VII], and to the solution are added 100 ml of deoxidized methanol. The mixture is then cooled to less than 10° C.

Aside from this, 10 g of sodium hydroxide are dissolved into 50 ml of water, and to it are further added 100 ml of methanol resulting in a mixture which is sufficiently deoxidized.

This solution is also cooled to less than 10° C., and then is added dropwise, under a nitrogen flow, to the foregoing Intermediate [VII]-containing solution. The mixture is stirred under the nitrogen atmosphere until conversion of Intermediate [VII] is confirmed by thin layer chromatography. The liquid is then poured into 1.5 liters of ice water containing 40 ml of concentrated hydrochloric acid to deposit a precipitate. The precipitate is filtered, collected and then dried. Yield: 6.5 g.

Examples of the present invention will be illustrated in detail below, but the present invention is not limited thereto.

EXAMPLE 1

Table 1 shows the results obtained by measuring, in the following manners, the spectral absorption characteristic and the stability to light of the dye released from the cyan dye image formable material of the present invention.

(1) Spectral Absorption Characteristic: The released dye is used to dye a mordant layer provided in a transparent support. The spectral absorption spectrum of the film strip is measured by means of a spectrophotometer. The maximum absorption wavelength (λmax) and the half-value width (the wavelength range of the absorption spectrum having the density corresponding to a half of the maximum absorption density) thereby obtained.

(2) Stability to Light of the Dye: The dyed film strip is subjected to strong light irradiation to examine its stability. That is, the dyed film strip having a transmission density of from 1.0 to 1.5, is irradiated over a period of 24 hours by a 6000 W xenon lamp. The irradiation light intensity is 60,000 luxes. The optical densities Do and D in λmax before and after the irradiation were measured, and the dye's residual percentage (%)=(D/Do)×100 was found. The dyes used in the measurement are those compounds having the following formula with those substituents as shown in Table 1.

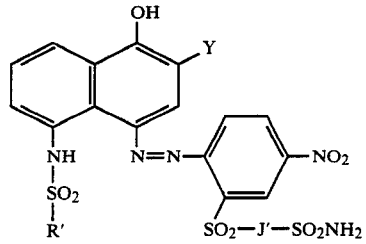

The mordant used is a styrene-N,N-dimethyl-N-benzyl-N-p-(methacroylaminophenyl)methyl-ammonium chloride-divinylbenzene ternary copolymer (molar ratio: 48:48:4).

TABLE 1

| | R' | J' | Y | λmax (nm) | Half-value width (nm) | Light resistance (residual %) |
|---|---|---|---|---|---|---|
| 1 | $-N(CH_3)_2$ | $-CH_2CH_2-$ 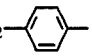 | $-SO_2NHCOCH_3$ | 660 | 93 | 87(%) |
| 2 | " | " | $-SO_2NHCOC_2H_5$ | " | " | " |
| 3 | " | " | $-SO_2NHCH_2CH_2OCH_3$ | 657 | 101 | 91 |
| 4 | " | " | $-SO_2N(CH_2CH_2OCH_3)_2$ | " | 98 | " |
| 5 | " | $-CH_2CH_2CH_2-$ | $-SO_2NHCH_2CH_2OH$ | " | 99 | 88 |
| 6 | " | $-CH_2CH_2-$ 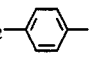 | $-SO_2NHCH_2COOH$ | 650 | 87 | 89 |

TABLE 1-continued

| | R' | J' | Y | λmax (nm) | Half-value width (nm) | Light resistance (residual %) |
|---|---|---|---|---|---|---|
| 7 | " | " | $-SO_2NH-C_6H_4-COOH$ | 658 | 99 | 90 |
| 8 | $-N(C_2H_5)_2$ | $-CH_2CH_2CH_2-$ | $-SO_2NHCH_2CH_2OCH_3$ | " | 93 | " |
| 9 | " | $-CH_2CH_2-C_6H_4-$ | $-SO_2NHCH_2CH_2COOH$ | 655 | 90 | 87 |
| 10 | 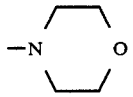 | " | $-SO_2NHCOCH_3$ | 656 | 103 | 93 |
| 11 | $-N(CH_3)_2$ | " | $-SO_2NHC(CH_3)_3$ | 660 | 100 | 90 |
| 12 | " | " | $-SO_2N[CH(CH_3)_2]_2$ | " | 102 | 85 |
| 13 | " | " | $-SO_2NH_2$ | 652 | 100 | 80 |

As can be understood from the above table, the dyes (No. 1 to No. 10) from the DRR compounds of the present invention have excellent characteristics as the cyan dye as compared to the comparative dyes (No. 11 to No. 13).

EXAMPLE 2

The following layers were coated in the described order on a 150μ-thick transparent polyethylene terephthalate film support, thereby preparing a multilayered monochromatic light-sensitive element.

(1) Image-receiving layer containing gelatin (2.5 g/m²) and poly(styrene-co-vinyl-benzyl chloride-co-N-benzyl-N,N-dimethyl-N-vinyl-benzyl-ammonium chloride-co-divinylbenzene) (molar ratio: 4.90:0.49:4.41:0.2) (2.5 g/m²).

(2) White reflective layer containing titanium dioxide (22 g/m²) and gelatin (2.2 g/m²).

(3) Light-shield layer containing carbon black (2.8 g/m²) and gelatin (1.8 g/m²).

(4) Cyan dye image forming material layer containing a cyan DRR compound (Exemplified Compound 7) of the invention (0.6 g/m²), N,N-diethyl-laurylamide (1.0 g/m²), and gelatin (2.5 g/m²).

(5) Red-sensitive emulsion layer containing a red-sensitive internal latent image-type direct positive silver bromide emulsion (silver equivalent of 0.75 g/m²), potassium 2-octadecyl-hydroquinone-5-sulfonate (0.08 g/m²), 1-[4-(2-formyl-hydrazine)phenyl]-3-phenyl-thiourea (2.5 mg per mole of silver), and gelatin (1.65 g/m²).

(6) Protective layer containing mucochloric acid (100 mg/m²) and gelatin (1 g/m²).

In the above, the C.P.M.-dispersed liquid was prepared in the following manner:

One gram of the C.P.M. was dissolved into 3 ml of ethyl acetate, and the N,N-diethyl-laurylamide was added to the solution. The resulting solution was emulsified to be dispersed into a 10% aqueous gelatin solution containing 0.24 g of Alkanol XC (a product of DuPont).

If the C.P.M. is less-soluble in ethyl acetate, cyclohexanone is used.

Subsequently, on a 100 μm-thick transparent polyethylene terephthalate film support, the following layers were coated in the described order, thereby preparing a processing sheet.

(1) Neutralizing layer containing an acrylic acid-butyl acrylate copolymer (70/30% by weight) (22 g/m²).

(2) Timing layer comprising a mixture (80:20) of poly(vinylidene chloride-co-itaconic acid-co-methyl acrylate)latex (55/6/39% by weight) with an acid/butyl ester (30/70% by weight) lactone polymer produced by the hydrolysis, lactonization, and partial esterification of a methacryl alcohol-maleic anhydride copolymer with 1-butanol.

The foregoing multilayered monochromatic light-sensitive element is subjected to a given exposure through an optical silver 30-step wedge with each step having a density difference of 0.10. The above processing sheet is then superposed on the light-sensitive element, and further a pod containing the following processing composition is attached to between the processing sheet and element, thus preparing a film unit. The film unit is then passed between a pair of juxtaposed pressure rollers with a gap of about 75μ therebetween to thereby rupture the pod to spread the contents thereof into and between the above light-sensitive element and the processing sheet.

The processing composition used herein is as follows:

| | |
|---|---|
| Potassium hydroxide | 56.0 g |
| Sodium sulfite | 2.0 g |
| 4-hydroxymethyl-4-methyl-1-phenyl-3-pyrazolidine | 8.0 g |
| 5-methylbenzotriazole | 2.8 g |
| Carbon Black (Raven-450, manufactured by Columbian Carbon) | 150.0 g |
| Sodium carboxymethyl cellulose (high viscous type, manufactured by Tokyo Kasei) | 50.0 g |
| Benzyl alcohol | 1.5 ml |
| Distilled water to make | 1000.0 ml |

After the processing, the produced dye image was observed through the transparent support of the light-sensitive element. The reflection densities of the dye image were measured in succession through a red filter (λmax = 644 nm) by a photoelectric densitometer.

The following Table 2 shows the time (t 0.5) required to reach the 50% and the time (t 0.8) required to reach the 80% of the maximum density (Dmax). Dmax is obtained 15 minutes after the commencement of the processing. The lengths of these periods of time will be criteria for the image forming speed. In addition, the temperature applied during the foregoing processing was 25° C.

In the foregoing light-sensitive element, the sample prepared with use of Exemplified Compound (7) of the present invention in the 4th layer was regarded as Sample A. The other samples are prepared in quite the same manner as in Sample A with the exception that Exemplified Compounds (8), (11) and (15) were used in place of the Exemplified Compound (7) to yield Sample B, Sample C, and Sample D, respectively. Further, as comparative compounds, the following Compound (1) and Compound (2) were used to prepare Sample E and Sample F, respectively.

Comparative Compound (1)

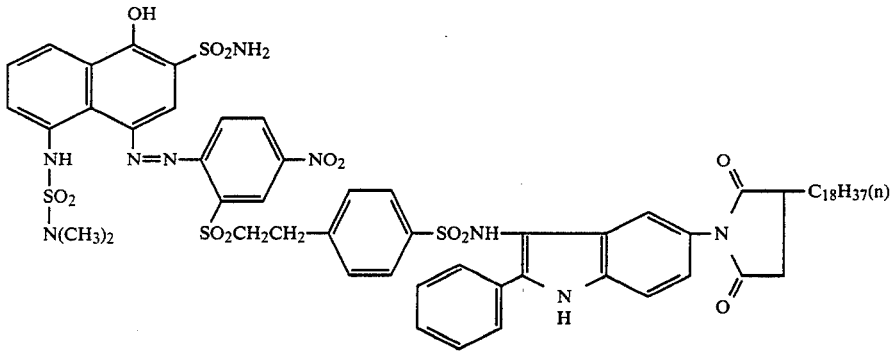

Comparative Compound (2)

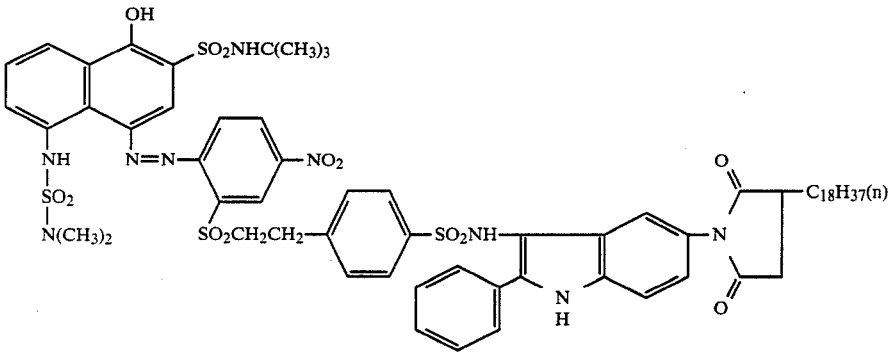

TABLE 2

| Sample | DRR compound | Dmax | t 0.5 | t 0.8 |
|---|---|---|---|---|
| A (invention) | Exemplified compound (7) | 2.20 | 0.58 (min) | 1.50 (min) |
| B (invention) | Exemplified compound (8) | 2.17 | 1.02 (min) | 1.53 (min) |
| C (invention) | Exemplified compound (11) | 2.01 | 1.12 (min) | 2.10 (min) |
| D (invention) | Exemplified compound (15) | 1.95 | 1.05 (min) | 2.15 (min) |
| E (comparative) | Comparative compound (1) | 1.91 | 1.18 (min) | 2.28 (min) |
| F (comparative) | Comparative compound (2) | 1.83 | 1.10 (min) | 2.10 (min) |

As apparent from the above table, these DRR compounds represented by the exemplified compounds of the present invention are capable of giving high color densities and excellent in the image forming speed as compared to the comparative compounds.

EXAMPLE 3

On a 180μ-thick opaque polyethylene terephthalate film support, the following layers were coated in the described order to prepare a multilayered, multicolor light-sensitive element.

(1) Layer containing an acrylic acid-butyl acrylate copolymer (70:30% by weight) (10 g/m$^2$) and silane coupling agent (manufactured by Tore Silicone) (0.2 g/m$^2$).

(2) Layer containing a mixture (50:50) of poly(vinylidene chloride-co-acrylonitrile-co-acrylic acid)latex (75:15:10% by weight) and an acid/butyl ester (15:85% by weight) lactone polymer produced by the hydrolysis, lactonization, and partial esterification of an aryl acetate-maleic anhydride copolymer with 1-butanol (2.6 g/m$^2$).

(3) Layer containing Exemplified Compound (7) of the present invention (cyan DRR compound) (0.54 g/m$^2$), tricresyl phosphate (0.27 g/m$^2$), and gelatin (1.65 g/m$^2$).

(4) Layer containing a red-sensitive negative-type silver halide emulsion (silver coating amount 0.35 g/m$^2$), potassium 2-(sec)octadecyl-hydroquinone-5-sulfonate (0.04 g/m$^2$) and gelatin (0.75 g/m$^2$).

(5) Layer containing 2-acetyl-5-octadecyl-hydroquinone (0.45 g/m$^2$) and gelatin (1.25 g/m$^2$).

(6) Layer containing the following magenta DRR compound (0.46 g/m$^2$), tricresyl phosphate (0.23 g/m$^2$) and gelatin (1.65 g/m$^2$).

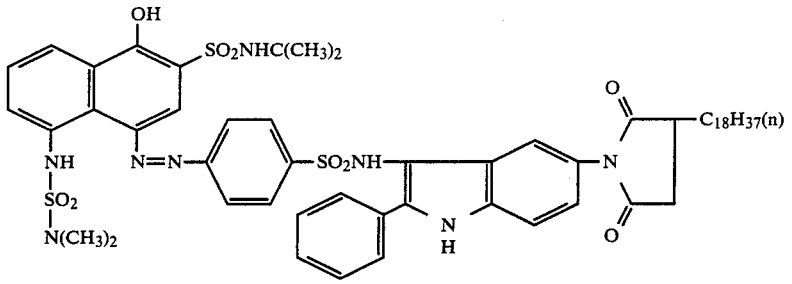

(7) Layer containing a green-sensitive negative-type silver halide emulsion (silver coating amount 0.5 g/m$^2$), potassium 2-octadecyl-hydroquinone-5-sulfonate (0.04 g/m$^2$) and gelatin (0.75 g/m$^2$).

(8) Layer containing 2-acetyl-5-octadecyl-hydroquinone (0.45 g/m$^2$) and gelatin (1.25 g/m$^2$).

(9) Layer containing the following yellow DRR compound (0.5 g/m$^2$), tricresyl phosphate (0.25 g/m$^2$) and gelatin (1.65 g/m$^2$).

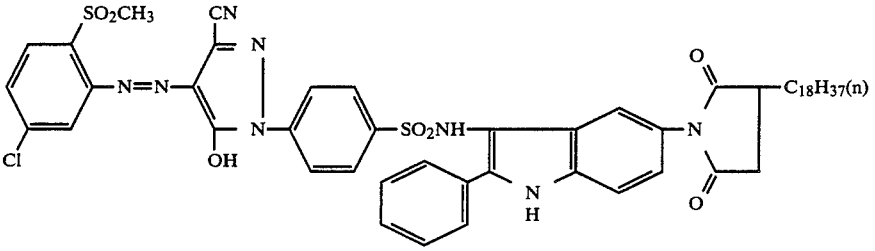

(10) Layer containing a blue-sensitive negative-type silver halide emulsion (silver coating amount 0.5 g/m$^2$), potassium 2-octadecyl-hydroquinone-5-sulfonate (0.052 g/m$^2$) and gelatin (0.75 g/m$^2$).

(11) Layer containing 2-acetyl-5-octadecyl-hydroquinone (0.2 g/m$^2$), silicon oxide having particle sizes of 2–4 $\mu$ (0.015 g/m$^2$), glyoxal (0.2 g/m$^2$) and gelatin (0.8 g/m$^2$).

The above-prepared multilayered, multicolor light-sensitive element was regarded as Sample G. Another light-sensitive element Sample H was prepared in quite the same manner as in Sample G except that the process control layers (consisting of the first and second layers) were excluded.

As comparative samples, in place of the compound of the invention, the foregoing Comparative Compound (1) was used to prepare Samples I and J as the counterparts of Samples G and H, respectively.

The above-prepared samples each was exposed through an optical wedge to light, and then processed by immersing it for 20 seconds at 25° C. in a shallow tray-type processor filled with an activator liquid of the following composition:

| Activator Composition: | |
|---|---|
| Potassium hydroxide | 56.2 g |
| 5-methyl-benzotriazole | 7.2 g |
| 11-aminoundecanoic acid | 2.0 g |
| Potassium bromide | 2.0 g |

-continued

| Activator Composition: |
|---|
| Water to make 1 liter |

Subsequently, each of the above light-sensitive element samples was superposed upon an image-receiving sheet prepared by coating the following layers in the described order on an opaque paper support.

Image Receiving Sheet (1) Dye image-receivable layer comprising a styrene-N,N-dimethyl-N-benzyl-N-p-(methacroylamino-phenyl)methyl-ammonium chloride-divinyl benzene ternary copolymer (molar ratio: 48:48:4) (2.7 g/m$^2$), gelatin (2.7 g/m$^2$), and 4-hydroxymethyl-4-methyl-3-pyrazolidinone (0.33 g/m$^2$).

(2) Interlayer containing gelatin (1.2 g/m$^2$), an ultraviolet absorbing agent, a mixture consisting of 2-(2-hydroxy-3-tertbutyl-5-n-butyl-phenyl)benzotriazole, 2-(2-hydroxy-3-tert-butyl-5-methyl-phenyl)-6-chlorobenzotriazole, 2-(2-hydroxy-3,5-dibutyl-phenyl)benzotriazole and 2-(2-hydroxy-5-n-butyl-phenyl)benzotriazole (0.8 g/m$^2$), and glyoxal (0.06 g/m$^2$).

(3) Protective layer of gelatin (0.65 g/m$^2$).

(4) Overcoat layer comprised of gelatin (0.27 g/m$^2$) and silica (1.4 g/m$^2$).

Each superposed element-sheet was passed between a pair of juxtaposed pressure rollers. The superposed light-sensitive element was peeled away from the image-receiving layer one minute later, and the density of the dye transferred onto the image-receiving element side was then measured. Further, the superposing time was varied as given in the following table, and the transferred dye's densities were measured in the same manner.

The following table shows the values obtained by measuring the reflection densities of the above dye images by a photoelectric densitometer through a red filter ($\lambda$ max 644 nm). In addition, as Samples H and J have no process control layers, the dye measurements were made after their peeled image-receiving elements were immersed in a buffer solution.

TABLE 3

| Sample | Superposing time 1 min. | 3 min. | 5 min. | 10 min. | Presence of process control layers |
|---|---|---|---|---|---|
| G (invention) | 0.54 | 2.21 | 2.45 | 2.48 | Present |
| I (comparative) | 0.38 | 1.55 | 1.72 | 1.80 | Present |
| H (invention) | 0.53 | 2.15 | 2.50 | 2.97 | None |
| J (comparative) | 0.32 | 1.75 | 2.23 | 2.80 | None |

As apparent from the above table, it is understood that the light-sensitive element samples of the present invention, Samples G and H, require shorter periods of time to reach the maximum transfer image densities than do the comparative photographic light-sensitive element samples. Further, even when the process control layers are provided behind the cyan DRR compound-containing layer, the reduction of the transfer dye density is extremely small.

EXAMPLE 4

The following two different photographic elements were prepared by use of a positive image-formable dye-releasing C.P.M. comprising the cyan dye of the present invention, and a counter-part thereof for comparison, respectively.

Sample for the Invention

The following layers were coated in order over the layers (1) and (3) prepared in Example 2 provided on the 150μ-thick transparent polyethylene terephthalate film support, whereby Sample K was prepared.

(1) Cyan dye-providable layer containing a negative-type silver halide emulsion (silver coating amount 1.08 g/m$^2$), the foregoing positive image-formable dye releasing C.P.M. (Exemplified Compound (17)) (0.47 g/m$^2$), the following pyrazole-type electron donator (0.5 g/m$^2$), N,N-diethyl-laurylamide (0.97 g/m$^2$) and gelatin (1.94 g/m$^2$).

(2) Protective layer containing tetrakis(vinyl-sulfonylmethine)methane (0.2 g/m$^2$) and gelatin (2 g/m$^2$).

Comparative sample

Sample L was prepared in the same manner as in the above with the exception that the positive image-formable cyan dye-releasing C.P.M. (Exemplified Compound 17) in the layer (1) of the above light-sensitive element of this example was replaced by the following Comparative Compound (3).

Each of the above-prepared multilayered monochromatic light-sensitive elements was subjected to a given exposure through a silver step representing a wedge with each step density difference of 0.10. Each element was then superposed on the processing sheet prepared in Example 2, and a pod containing the same processing composition as used in Example 2 was provided therebetween to prepare a film unit. The prepared film unit was passed between a pair of juxtaposed pressure rollers to thereby rupture the pod to spread the contents thereof into and between the light-sensitive element and the processing sheet. The changing densities to red light during 15 minutes immediate after the commencement of the development were measured continually at a temperature of 25° C.

Table 4 shows the time (t 0.5) required for the dye to reach the 50% and the time (t 0.8) to reach the 80% of the maximum density (Dmax). Dmax is obtained 15 minutes after the commencement of the development.

TABLE 4

| Sample | Positive image-formable cyan dye-releasing C.P.M. | Dmax | t 0.5 | t 0.8 |
|---|---|---|---|---|
| K (invention) | Exemplified compound (17) | 2.10 | 1.02 min. | 2.05 min. |
| L (comparative) | Comparative compound (3) | 1.71 | 1.20 min. | 2.30 min. |

From the results shown in Table 4, it is understood that the positive image-formable dye-releasing compound comprising the cyan dye portion for the present invention is capable of giving a high density and has excellent speed as compared to the comparative compound having the same Car portion.

Pyrazole-Type Electron Donator

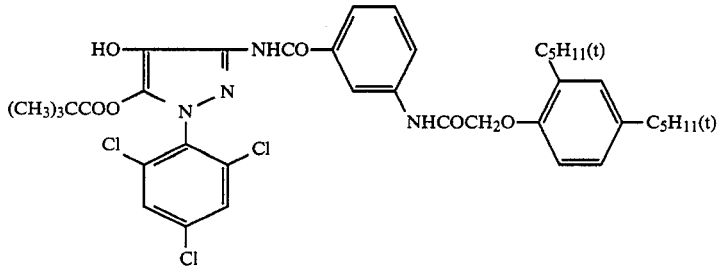

Comparative Compound (3)

-continued

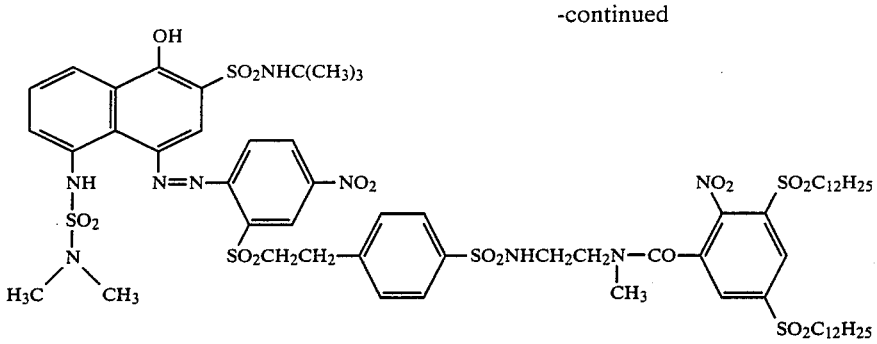

What is claimed is:

1. A photographic light-sensitive element comprising a support having thereon at least one light-sensitive silver halide emulsion layer and a dye image forming non-diffusible material which releases a diffusible cyan dye or the precursor thereof wherein said dye image forming material is a compound of Formula I:

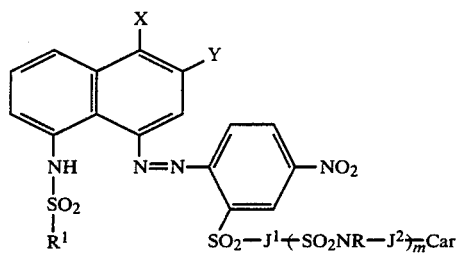

(I)

wherein Car represents a carrier component having at least one Ball ballasting group as a part thereof which alone or together with other such groups in said Car renders said compound non-diffusible during development in an alkaline processing solution, said Car being capable of releasing from said compound a diffusible dye or the precursor thereof as the result of a redox reaction under alkaline conditions;

R represents a hydrogen atom or an alkyl group having from 1 to 3 carbon atoms;

$R^1$ is

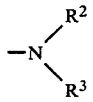

wherein $R^2$ and $R^3$ are independently selected from a hydrogen atom, or an alkyl having from 1 to 3 carbon atoms, a cycloalkyl or an aryl group, and $R^2$ and $R^3$ may be linked through an oxygen atom or nitrogen atom to each other to form a 5-membered or 6-membered ring;

X is hydroxyl group or a salt thereof or a group which can be hydrolyzed to a hydroxyl group;

Y is

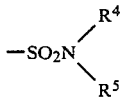

wherein $R^4$ is selected from the group consisting of acyl, hydroxyalkyl, alkoxyalkyl, alkoxyalkyleneoxyalkyl, carboxyalkyl, carboxyphenyl, carboxyalkyl-phenyl, hydroxyalkyl-phenyl, and alkoxyphenyl group;

$R^5$ is selected from the group consisting of hydrogen, alkyl or aryl having from 1 to 8 carbon atoms, and the same group $R^4$ is selected from, provided the sum of the number of carbon atoms contained in $R^4$ and $R^5$ is not more than 10;

m is an integer of 0 or 1; and $J^1$ and $J^2$ are independently selected from divalent groups having the formula; $—R^6—(O)_n—R_p^7—$ wherein $R^6$ and $R^7$ are independently selected from alkylene having from 1 to 8 carbon atoms, phenylene and phenylene substituted by a chlorine atom, a methoxy group, or a methyl group;

n is an integer of 0 or 1; p is 1 when n is 1, and p is 1 or 2 when n is 0, provided that when p is 1, the sum of the number of the carbon atoms contained in $R^6$ and $R^7$ is not more than 13.

2. The photographic light-sensitive element of claim 1, wherein said X is selected from acetoxy, chloroacetoxy, trifluoroacetoxy, and benzoyloxy.

3. The photographic light-sensitive element of claim 1, wherein said $J^1$ is a divalent group selected from the class consisting of

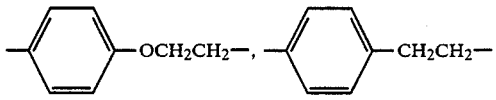

and $—CH_2CH_2CH_2—$ and said $J^2$ is

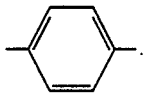

4. The photographic light-sensitive element of claim 1, wherein said Car is

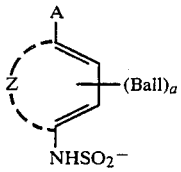

(II)

wherein Z represents a group of atoms, inclusive of those to which A and the $—NHSO_2—$ group in Formula II are attached, necessary to form a benzene ring, a naphthalene ring or a heterocyclic ring selected from pyrazolone and pyridine;

A represents $OR^8$ or $NHR^9$ wherein $R^8$ *l is a hydrogen atom or a group which is hydrolyzed to provide a hydroxy group and* $R^9$ is a hydrogen atom or an alkyl group having from 1 to 20 carbon atoms, said alkyl group being allowed to function as an independent Ball; and a is an integer of 1 or 2.

5. The photographic light-sensitive element of claim 1, wherein said Car is Formula (III)

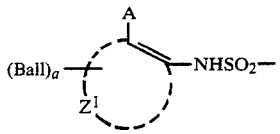

(III)

wherein $Z^1$ represents a group of atoms necessary to form a benzene ring, a naphthalene ring or a heterocyclic ring selected from pyrazolone and pyridine;

A represents $OR^8$ or $NHR^9$ wherein $R^8$ is a hydrogen atom or a group which is hydrolyzed to provide a hydroxy group and $R^9$ is a hydrogen atom or an alkyl group having from 1 to 20 carbon atoms, said alkyl group being allowed to function as an independent Ball; and a is an integer of 1 or 2.

6. The photographic light-sensitive element of claim 1, wherein said Car is Formula (IV)

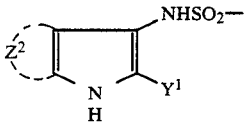

(IV)

wherein $Y^1$ is selected from hydrogen atom, alkyl, aryl, heterocyclic group, and —CO—$G^1$;

$G^1$ is —$OG^2$—$SG^2$ or

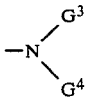

wherein $G^2$ is selected from hydrogen, alkyl, cycloalkyl, and aryl;

$G^3$ is selected from the same group as $G^2$, and an acyl group derived from an aliphatic or an aromatic carboxylic acid or from sulfonic acid;

$G^4$ *l is a hydrogen atom or an alkyl group;*

$Z^2$ is a residue necessary to complete a condensed benzene ring, provided said condensed benzene ring can have at least one substituent, and said condensed benzene ring or $Y^1$ have a Ball group as a substituent.

7. The photographic light-sensitive element of claim 1, wherein said Car is Formula (V)

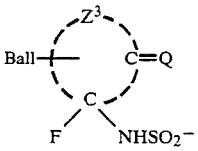

(V)

wherein Ball represents an organic ballasting group having such a number of carbon atoms so as to be capable of making said compound nondiffusible in said alkaline processing composition during the period of development therein;

Q is an oxygen atom or NQ′ wherein Q′ is a hydroxyl group or amino group;

$Z^3$ is a saturated or unsaturated 5- to 7-member-cyclic nonaromatic hydrocarbon, said cyclic hydrocarbon being allowed to fuse with an aromatic hydrocarbon ring or a heterocyclic ring to form a condensed ring; and F is a hydrogen atom or a halogen atom.

8. The photographic light-sensitive element of claim 1, wherein said Car is Formula (VI)

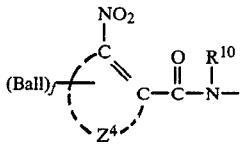

(VI)

wherein $Z^4$ represents a group of atoms necessary to form a benzene ring; $R^{10}$ is an alkyl group having from 1 to 4 carbon atoms; and f is 1 or 2.

9. The photographic light-sensitive element of claim 1, wherein said Car group is Formula (VII)

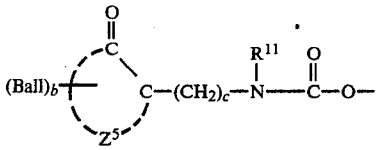

(VII)

wherein $R^{11}$ is an alkyl group having from 1 to 40 carbon atoms;

b is 0 or 1; provided that when b is 0, $R^{11}$ is an alkyl having at least 8 carbon atoms;

c is an integer of 0 to 1; and $Z^5$ is a group of atoms necessary to complete a quinone ring.

10. The photographic light-sensitive element of claim 1, wherein said Car is Formula (VIII)

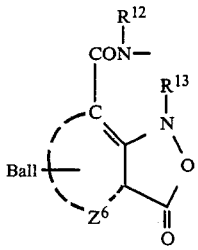

(VIII)

wherein $Z^6$ represents a group of atoms necessary to form a benzene ring; and $R^{12}$ and $R^{13}$ each is an alkyl group having from 1 to 4 carbon atoms.

11. The photographic light-sensitive element of claim 1, wherein said Car is Formula (IX)

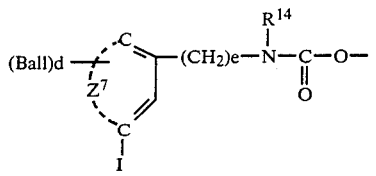

(IX)

wherein $R^{14}$ is an alkyl group having from 1 to 40 carbon atoms;

d is 0 or 1, provided that when d=0, $R^{14}$ is an alkyl having at least 8 carbon atoms;

e is an integer of 0 or 1;

$Z^7$ is a group of atoms necessary to complete a hydroquinone ring;

and I is hydroxyl group or a precursor which can be hydrolyzed to a hydroxyl group.

12. The photographic light-sensitive element of claim 1, wherein said Car is Formula (Xa) or (Xb)

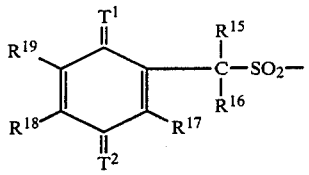

(Xa)

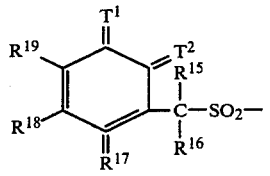

(Xb)

wherein $T^1$ and $T^2$ are independently selected from oxygen and imino;

$R^{15}$ and $R^{16}$ are independently selected from hydrogen and alkyl; $R^{17}$, $R^{18}$ and $R^{19}$ are independently selected from hydrogen, halogen, alkyl, alkoxy, and acylamino, provided that groups adjacent to each other may combine with each other to form condensed rings, and at least one of said $R^{15}$ to $R^{19}$ is an organic Ball group.

13. The photographic light-sensitive element of claim 1, wherein said Car group is Formula (XI)

$$[Me(Lig^1)_v(Lig^2)_q(Lig^3)_r(Lig^4)_s](B)_t \quad (XI)$$

wherein Me is a transition metal; $Lig^1$ and $Lig^2$ are each a multidentate ligand; $Lig^3$ and $Lig^4$ are each a coordinatable ligand; B is a counter ion; v is an integer of from 1 to 3; q is an integer of up to 2, provided that, when q is 0, v is at least 2; r and s are independently integers of up to 4, and t is an integer of up to 6.

14. The photographic light-sensitive element of claim 1, wherein said support has thereon a red-sensitive silver halide emulsion layer having a cooperative relation with said cyan or shifted cyan dye image forming material of said Formula (I), a green-sensitive silver halide emulsion layer having a cooperative relation with a magenta or shifted magenta dye image forming material, and a blue-sensitive silver halide emulsion layer having a cooperative relation with a yellow or shifted yellow dye image forming material.

15. The photographic light-sensitive element of claim 1, wherein the coating amount of said cyan dye image forming material is from $2\times10^{-4}$ to $2\times10^{-3}$ moles/$m^2$.

16. The photographic light-sensitive element of claim 1, wherein said dye image forming material is cross-oxidized with a developing agent oxidized at the time of reducing said silver halide into metallic silver, and the cross-oxidized product undergoes alkali hydrolysis to release an imagewise-distributed diffusible dye.

17. The photographic light-sensitive element of claim 4, wherein said Ball represents alkyl acylamido, aryl acylamido, succinimido or phthalimido group.

18. The photographic light-sensitive element of claim 5, wherein said Ball represents alkyl acylamido, aryl acylamido, succinimido or phthalimido group.

19. The photographic light-sensitive element of claim 6, wherein said Ball group represents alkyl acylamido, aryl acylamido, succinimido or phthalimido group.

20. The photographic light-sensitive element of claim 7, wherein said Ball represents alkyl acylamido, aryl acylamido, succinimido or phthalimido group.

21. The photographic light-sensitive element of claim 8, wherein said Ball group represents alkyl acylamido, aryl acylamido, succinimido or phthalimido group.

22. The photographic light-sensitive element of claim 9, wherein said Ball group represents alkyl acylamido, aryl acylamido, succinimido or phthalimido group.

23. The photographic light-sensitive element of claim 10, wherein said Ball group represents alkyl acylamido, aryl acylamido, succinimido or phthalimido group.

24. The photographic light-sensitive element of claim 11, wherein said Ball group represents alkyl acylamido, aryl acylamido, succinimido or phthalimido group.

25. The photographic light-sensitive element of claim 1, wherein said light-sensitive element further comprises a process control layer in combination with a light-sensitive silver halide emulsion layer.

26. The photographic light-sensitive element of claim 25, wherein said process control layer consists essentially of a neutralizing layer and timing layer.

27. The photographic light-sensitive element of claim 25, wherein said process control layer is arranged between said light-sensitive silver halide emulsion layer and said support.

28. The photographic light-sensitive element of claim 26, wherein said neutralizing layer comprises a polymeric acid.

29. The photographic light-sensitive element of claim 1, wherein said diffusible dye is released as an inverse function of said development of said silver halide emulsion layer under alkaline conditions.

30. The photographic light-sensitive element of claim 1, wherein said Car is Formula (XII)

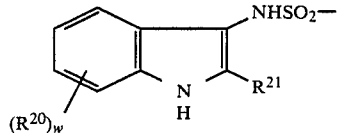

(XII)

wherein $R^{20}$ is selected from alkyl and alkoxy having 1 to 3 carbon atoms;

$R^{21}$ is selected from from tert-butyl, tert-amyl, phenyl, and

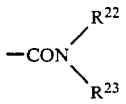

wherein $R^{22}$ and $R^{23}$ are independently selected from hydrogen and alkyl; and w is an integer of 0 to 3.

31. A photographic film unit comprising:

(a) said photographic light-sensitive element of claim 1;

(b) a dye image receiving layer; and (c) means to squeeze out said alkaline processing composition inside said film unit.

32. The photographic film unit of claim 31, wherein said dye image receiving layer contains silver halide developing agent.

33. The photographic film unit of claim 32, wherein said developing agent is a 1-phenyl-3-pyrazolinone derivative.

34. The photographic film unit of claim 33, wherein said developing agent is 1-phenyl-4-methyl-4-hydroxymethyl-3-pyrazolinone.

35. The photographic film unit of claim 31, wherein said dye image receiving layer is located between said support and said light-sensitive silver halide emulsion layer.

36. The photographic film unit of claim 31, wherein said film unit further comprises a transparent cover sheet over the layer outermost from said support.

37. The photographic film unit of claim 36, wherein said film unit further comprises a neutralizing layer and a timing layer on said cover sheet in this order.

38. A process for forming a photographic transfer image comprising:

(a) imagewise exposing said photographic light-sensitive element of claim 1;

(b) treating said imagewise-exposed light-sensitive element with an alkaline processing composition in the presence of a silver halide developing agent, whereby said image forming material then releases said diffusible dye imagewise; and (c) at least a portion of said diffusible dye diffusing in an imagewise distribution to a dye image receiving layer.

39. The process of claim 38, wherein said alkaline processing solution is a nonviscous alkaline processin solution.

40. The element of claim 7 wherein F is chloride, bromide or fluoride.

41. The element of claim 13 wherein said transition metal is selected from Ni and Co.

* * * * *